US011128971B2

(12) United States Patent
Landemaine et al.

(10) Patent No.: US 11,128,971 B2
(45) Date of Patent: Sep. 21, 2021

(54) SYSTEMS AND METHODS FOR ASSEMBLING AN ELECTRO-ACOUSTIC TRANSDUCER INCLUDING A MINIATURE VOICE COIL

(71) Applicant: Bose Corporation, Framingham, MA (US)

(72) Inventors: Thomas Landemaine, Allston, MA (US); Brock N. Jacobites, Hopkinton, MA (US); Csaba Guthy, Hopkinton, MA (US); David W. Beverly, Lunenburg, MA (US); Eric McNicol, Spencer, MA (US)

(73) Assignee: BOSE CORPORATION, Framingham, MA (US)

( * ) Notice: Subject to any disclaimer, the term of this patent is extended or adjusted under 35 U.S.C. 154(b) by 279 days.

(21) Appl. No.: 16/445,581

(22) Filed: Jun. 19, 2019

(65) Prior Publication Data

US 2019/0306643 A1 Oct. 3, 2019

Related U.S. Application Data

(63) Continuation of application No. 15/783,499, filed on Oct. 13, 2017, now Pat. No. 10,375,495.
(Continued)

(51) Int. Cl.
*H04R 1/02* (2006.01)
*H04R 31/00* (2006.01)
(Continued)

(52) U.S. Cl.
CPC ..... *H04R 31/006* (2013.01); *H04R 9/045* (2013.01); *H04R 1/06* (2013.01); *H04R 9/046* (2013.01); *H04R 9/06* (2013.01)

(58) Field of Classification Search
CPC .... H04R 31/006; H04R 31/00; H04R 1/1033; H04R 1/06; H04R 9/02; H04R 9/06; H04R 9/045; H04R 9/046
See application file for complete search history.

(56) References Cited

U.S. PATENT DOCUMENTS 2,094,043 A 9/1937 Marshall
3,590,170 A 6/1971 Sawyer et al.
(Continued)

FOREIGN PATENT DOCUMENTS

CN 201163821 Y 12/2008
CN 101651921 A 2/2010
(Continued)

OTHER PUBLICATIONS

First Office Action in Chinese Patent Application No. 201880035277.4 dated Aug. 5, 2020.
(Continued)

*Primary Examiner* — Amir H Etesam
(74) *Attorney, Agent, or Firm* — Schmeiser, Olsen & Watts LLP; Timothy P. Collins

(57) ABSTRACT

A tool for arranging voice coil leadouts in a microspeaker comprises a mandrel having a top surface on which a bobbin and voice coil are positioned during formation of helicoidal leadout regions of the voice coil, a bobbin alignment feature for positioning at an inner diameter of the bobbin; a sleeve alignment element at a bottom region of the bobbin alignment feature, the sleeve alignment element having a first surface on which a sleeve of the microspeaker is positioned during the formation of the helicoidal leadout regions, and a gluing ring positioned about the mandrel and on a second surface of the sleeve alignment element for providing guide
(Continued)

paths for distal ends of the leadout end regions extending in a direction from the mandrel to the sleeve alignment element.

20 Claims, 26 Drawing Sheets

Related U.S. Application Data

(60) Provisional application No. 62/478,278, filed on Mar. 29, 2017.

(51) Int. Cl.

| | |
|---|---|
| ***H04R 9/04*** | (2006.01) |
| *H04R 9/06* | (2006.01) |
| *H04R 1/06* | (2006.01) |

(56) References Cited

U.S. PATENT DOCUMENTS

| | | | |
|---|---|---|---|
| 3,828,144 | A | 8/1974 | Yamamuro et al. |
| 3,963,882 | A | 6/1976 | Lewis |
| 4,225,757 | A | 9/1980 | Babb |
| 6,168,110 | B1 | 1/2001 | Stevens et al. |
| 6,243,472 | B1 | 6/2001 | Bilan et al. |
| 6,691,832 | B2 | 2/2004 | Moritake et al. |
| 7,460,682 | B2 | 12/2008 | Suzuki |
| 8,107,665 | B2 | 1/2012 | Haapapuro et al. |
| 8,155,372 | B2 | 4/2012 | North |
| 8,155,374 | B2 | 4/2012 | Yuasa et al. |
| 8,180,097 | B2 | 5/2012 | Harms et al. |
| 8,391,538 | B2 | 3/2013 | Chiu et al. |
| 8,798,309 | B2 | 8/2014 | Tagami et al. |
| 9,716,424 | B2 | 7/2017 | Stoltenberg et al. |
| 9,794,666 | B1 * | 10/2017 | Beverly ..... H04R 9/04 |
| 9,986,355 | B2 | 5/2018 | Pare et al. |
| 2004/0062415 | A1 | 4/2004 | Suzuki |
| 2004/0197004 | A1 | 10/2004 | Suzuki |
| 2004/0240702 | A1 | 12/2004 | Kaiwa et al. |
| 2005/0084130 | A1 | 4/2005 | Yamagishi |
| 2006/0231276 | A1 | 10/2006 | Robinson |
| 2010/0303278 | A1 | 12/2010 | Sahyoun |
| 2011/0033078 | A1 | 2/2011 | Liang et al. |
| 2012/0183169 | A1 | 7/2012 | Yang |
| 2012/0292401 | A1 | 11/2012 | Mahalingam et al. |
| 2016/0331645 | A1 | 11/2016 | Bagwell et al. |
| 2018/0288550 | A1 | 10/2018 | Guthy et al. |

FOREIGN PATENT DOCUMENTS

| | | | |
|---|---|---|---|
| CN | 102665160 | A | 9/2012 |
| CN | 205408161 | U | 7/2016 |
| CN | 205754835 | U | 11/2016 |
| DE | 102008024816 | A1 | 11/2009 |
| EP | 2120482 | A1 | 11/2009 |
| EP | 2563042 | A1 | 2/2013 |
| EP | 2892248 | A1 | 7/2015 |
| FR | 1400579 | A | 5/1965 |
| GB | 776280 | | 6/1957 |
| JP | S61139196 | A | 6/1986 |
| JP | H08251693 | A | 9/1996 |
| JP | 3098127 | B2 | 10/2000 |
| JP | 2003153382 | A | 5/2003 |
| JP | 3531257 | B2 | 5/2004 |
| JP | 4575515 | B1 | 11/2010 |
| JP | 4594858 | B2 | 12/2010 |
| JP | 4820916 | B1 | 11/2011 |
| KR | 100817743 | B1 | 3/2008 |
| KR | 101077569 | B1 | 10/2011 |
| WO | 2001045213 | A1 | 6/2001 |
| WO | 2017015228 | A1 | 1/2017 |
| WO | 2017218183 | A1 | 12/2017 |

OTHER PUBLICATIONS

First Office Action in Chinese Patent Application No. 201880033133.5 dated Jun. 2, 2020.
Notice of Allowance in U.S. Appl. No. 15/472,741 dated May 16, 2019; 10 pages.
Notice of Allowance in U.S. Appl. No. 15/181,989 dated Aug. 22, 2017; 12 pages.
International Search Report and Written Opinion in PCT/US2017/035157, dated Jul. 14, 2017; 9 pages.
International Search Report and Written Opinion in PCT/US2018/018278 dated May 15, 2018; 12 pages.
International Search Report and Written Opinion in PCT/US2018/018271 dated May 23, 2018; 13 pages.
International Preliminary Report on Patentability in PCT/US2017/035157 dated Dec. 27, 2018; 6 pages.
Restriction Requirement in U.S. Appl. No. 15/783,499 dated Feb. 4, 2019; 5 pages.
Notice of Allowance in U.S. Appl. No. 15/783,499 dated Mar. 20, 2019; 10 pages.
International Preliminary Report on Patentability in PCT/US2018/018278 dated Oct. 10, 2019; 7 pages.
International Preliminary Report on Patentability in PCT/US2018/018271 dated Oct. 10, 2019; 7 pages.
Non-Final Office Action in U.S. Appl. No. 16/541,745 dated Apr. 29, 2021.

* cited by examiner

SYSTEMS AND METHODS FOR ASSEMBLING AN ELECTRO-ACOUSTIC TRANSDUCER INCLUDING A MINIATURE VOICE COIL

RELATED APPLICATIONS

This application is a continuation application of U.S. patent application Ser. No. 15/783,499, filed Oct. 13, 2017 and entitled "Systems and Methods for Assembling an Electro-Acoustic Transducer Including a Miniature Voice Coil," which claims priority to U.S. Provisional Patent Application Ser. No. 62/478,278, filed Mar. 29, 2017 and entitled "Systems and Methods for Assembling an Electro-Acoustic Transducer Including a Miniature Voice Coil," the content of which is incorporated by reference herein in its entirety. This application is related to U.S. patent application Ser. No. 15/472,741, filed Mar. 29, 2017 and entitled "Systems and Methods for Assembling an Electro-Acoustic Transducer Including a Miniature Voice Coil," and U.S. patent application Ser. No. 15/181,989, filed Jun. 14, 2016 and entitled "Miniature Voice Coil Having Helical Lead-Out for Electro-Acoustic Transducer," the content of each of which is incorporated by reference herein in its entirety.

BACKGROUND

This description relates generally to transducers for headphones, and more specifically, voice coil leadout configurations of a miniature electro-acoustic transducer.

BRIEF SUMMARY

In accordance with one aspect, a tool for arranging voice coil leadouts in a microspeaker comprises a mandrel having a top surface on which a bobbin and voice coil of the microspeaker are positioned during formation of helicoidal leadout regions of a microspeaker voice coil; a bobbin alignment feature at a top region of, and adjacent the top surface of, the mandrel, the bobbin alignment feature constructed and arranged for positioning at an inner diameter of the bobbin; a sleeve alignment element at a bottom region of the bobbin alignment feature, the sleeve alignment element having a first surface on which a sleeve of the microspeaker is positioned during the formation of the helicoidal leadout regions; and a gluing ring positioned about the mandrel and on a second surface of the sleeve alignment element, the gluing ring constructed and arranged for providing guide paths for distal ends of the leadout end regions extending in a direction from the mandrel to the sleeve alignment element.

Aspects may include one or more of the following features.

The bobbin alignment feature, the mandrel, and sleeve alignment element may be of a single stock of material.

The bobbin alignment feature may be rotatably coupled to the mandrel.

The mandrel may be constructed and arranged to form the voice coil helicoidal leadout regions, the bobbin alignment feature may be constructed and arranged for centering the bobbin during the formation of the voice coil helicoidal leadout regions, and the sleeve alignment element may be constructed and arranged for centering of the sleeve during the formation of the voice coil helicoidal leadout regions.

The mandrel may include a conical sidewall portion for releasing the bobbin from the tool.

The gluing ring may include two insert notches constructed and arranged for receiving the distal ends of the helicoidal leadout regions.

The insert notches may include an adhesive for coupling portions of the voice coil helicoidal leadout regions to the gluing ring.

The sleeve alignment element may include a central portion; two extensions extending from the central portion; and a region of separation between each extension and the central portion, the regions of separation and central portion permitting wire tension to be maintained and forming the guide paths for the distal ends of the helicoidal leadout regions.

The gluing ring may have a rotation-locking feature, and the mandrel may have a non-circular surface for coupling with the rotation-locking feature to prevent rotation of the gluing ring about the mandrel.

The tool may further comprise an ejection device including: a base; first and second base blocks extending from the base for insertion into the regions of separation of the sleeve alignment element; and at least one ejection pin extending from the base for insertion into a corresponding ejection hole of the mandrel for removing the bobbin and voice coil from the tool.

In accordance with another aspect, an electro-acoustic transducer comprises a sleeve having a first end and a second end; a voice coil within the sleeve; a magnetic assembly in magnetic communication with the voice coil in the sleeve between the first end and the second end; a conductive wire extending from the voice coil, a portion of the conductive wire including helicoidal leadout regions; and a gluing ring coupled to an interior of the sleeve, the gluing ring including guide paths to which distal ends of the helicoidal leadout regions are coupled.

Aspects may include one or more of the following features.

The gluing ring may include two insert notches constructed and arranged for receiving the distal ends of the helicoidal leadout regions.

The insert notches may include an adhesive for coupling portions of the voice coil helicoidal leadout regions to the gluing ring.

In accordance with another aspect, a method for assembling an electro-acoustic transducer comprises positioning a gluing ring about a tool; positioning a bobbin and voice coil about the tool; aligning the bobbin and voice coil with the tool; forming helicoidal leadout regions by rotating distal regions of conductive wiring of the voice coil about the tool; extending distal ends of the helicoidal leadout regions through notches in the gluing ring; and positioning a sleeve about the bobbin, voice coil, and gluing ring.

Aspects may include one or more of the following features.

The method may further comprise inserting an ejection device into holes of the tool; and removing the tool from the bobbin, voice coil, sleeve, and gluing ring using the ejection device.

The method may further comprise coupling the gluing ring to an interior of the sleeve.

Forming the helicoidal leadout regions may comprise positioning the bobbin about a bobbin alignment feature of a tool and resting the bobbin on a top surface of a mandrel below the bobbin alignment feature, the mandrel including a conical sidewall; positioning the gluing ring about the mandrel and on a second surface of the sleeve alignment element; rotating the conductive wiring of the voice coil about the conical sidewall of the mandrel; and coupling the distal ends of the helicoidal leadout regions to the notches in the gluing ring.

The method may further comprise piloting the distal ends of the helicoidal leadout regions down the gluing ring notches; holding the distal ends in place by a clamping mechanism or bonding technique; and coupling distalmost ends of the distal ends to a circuit board at the bottom of the sleeve. The bonding technique may include an adhesive. The clamping mechanism may include the gluing ring notches reduced to clamp about the helicoidal leadout regions.

In accordance with another aspect, a tool for assembling an electro-acoustic transducer comprises a mandrel, comprising: a bobbin alignment feature about which a bobbin and voice coil are positioned during assembly of the electro-acoustic transducer; a sleeve alignment feature below the bobbin alignment feature about which a sleeve is positioned and aligned with the bobbin and voice coil during assembly of the of the electro-acoustic transducer; and a base portion below the sleeve alignment feature. The tool further comprises a lander core device constructed and arranged for insertion into a tooling apparatus and for removing the electro-acoustic transducer from the mandrel after assembly; and an insulative ring positioned at a lip between the sleeve alignment feature and the bobbin alignment feature for providing guide paths for distal ends of leadout regions of the voice coil, wherein the base portion communicates with the lander core device below the base portion and further communicates with the insulative ring.

Aspects may include one or more of the following features.

The electro-acoustic transducer after assembly may include the sleeve, bobbin, voice coil, and flex circuit.

The lander core device may comprise a bottom element constructed and arranged for insertion into the tooling apparatus, a first side pin and a second side pin constructed and arranged for communicating via the mandrel with the insulative ring, and a center pin constructed and arranged for communicating with a top surface of the bobbin.

The tool may further comprise a gap between the bottom element of the lander core device and a bottommost surface of the mandrel, wherein a maximum height of the gap is limited by a top region of the center pin of the lander core device.

The base portion of the mandrel may have a width greater than a width of the sleeve alignment feature, and further includes a lip that extends from an outermost circumference of the sleeve alignment feature for receiving the sleeve positioned about and aligned with the bobbin and voice coil.

The insulative ring may include two grooved extensions that extend vertically from the insulative ring for receiving and securing leadout wires of the voice coil.

In accordance with another aspect, a tool for assembling an electro-acoustic transducer comprises a mandrel, comprising: a bobbin alignment feature about which a bobbin and voice coil are positioned during assembly of the electro-acoustic transducer; a leadout hook ring alignment feature about which a conductive leadout hook ring and an insulative ring are positioned; a sleeve alignment feature below the bobbin alignment feature about which a sleeve is positioned and aligned with the bobbin and voice coil during assembly of the of the electro-acoustic transducer; and a base portion below the sleeve alignment feature, the tool further comprising: a lander core device constructed and arranged for insertion into a tooling apparatus and for removing the electro-acoustic transducer from the mandrel after assembly, wherein the base portion communicates with the lander core device and further communicates with the insulative ring, the conductive leadout hook ring, and the bobbin, and wherein the conductive leadout hook ring is configured to conductively connect with a leadout wire of the voice coil.

In accordance with another aspect, a transducer assembly is formed according to the method steps of: positioning a bobbin and voice coil about a mandrel of a tool; aligning the bobbin and voice coil with the mandrel; positioning an insulative ring about the mandrel for providing guide paths for distal ends of leadout regions of the voice coil; and rotating the bobbin about the mandrel to form helical portions of the voice coil.

The method steps may further comprise: loading the tool into a robot end of arm tooling (EoAT) apparatus to at least one of hold in place and align bobbin and voice coil of the transducer assembly or transfer the transducer assembly to a source of silicone for forming a surround.

BRIEF DESCRIPTION

The above and further advantages of examples of the present inventive concepts may be better understood by referring to the following description in conjunction with the accompanying drawings, in which like numerals indicate like structural elements and features in various figures. The drawings are not necessarily to scale, emphasis instead being placed upon illustrating the principles of features and implementations.

Figure 12B:
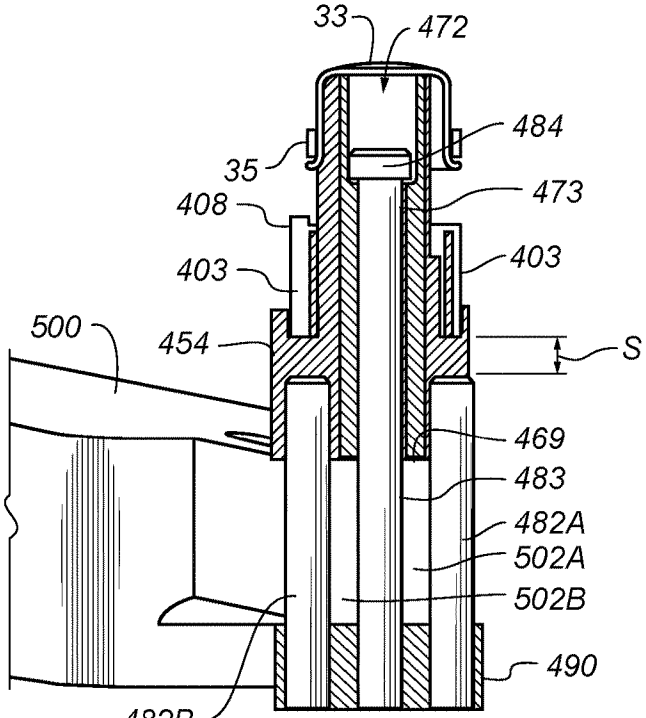
FIG. 12B is a cutaway perspective view of the miniature electro-acoustic transducer assembly and tool of FIG. 12A.
Figure 12A:
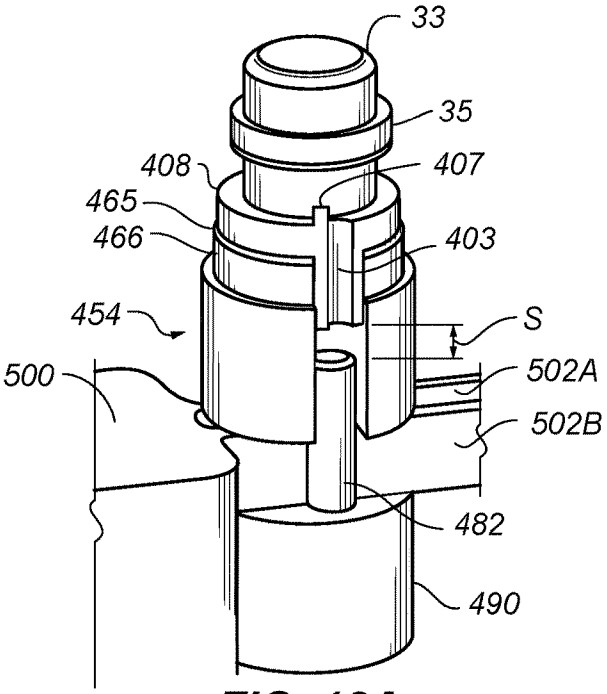
FIG. 12A is a perspective view of elements of a miniature electro-acoustic transducer assembly positioned on the tool of FIGS. 10A, 10B, and 11.
Figure 13C:
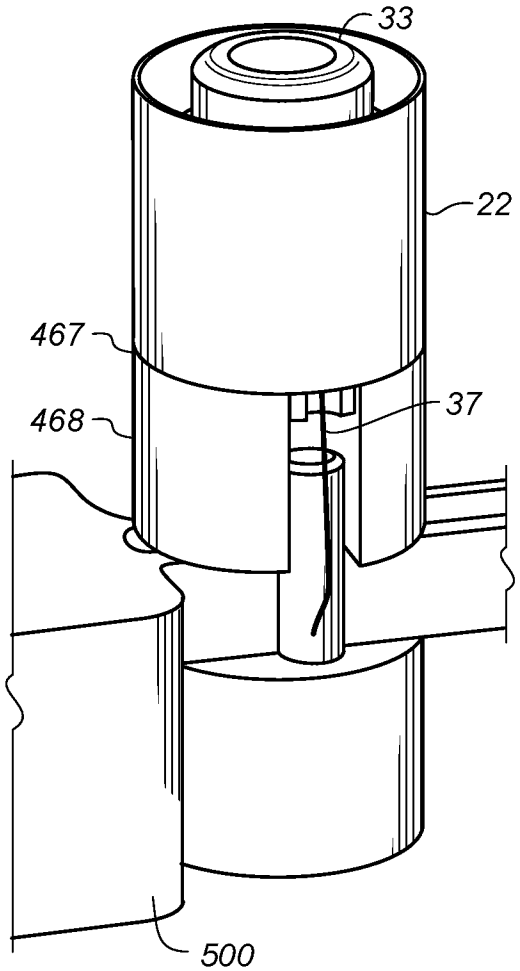
FIGS. 13A-13C are perspective views of an assembly that includes the tool of FIGS. 10A-12B forming a voice coil leadout, in accordance with some examples.
Figure 13B:
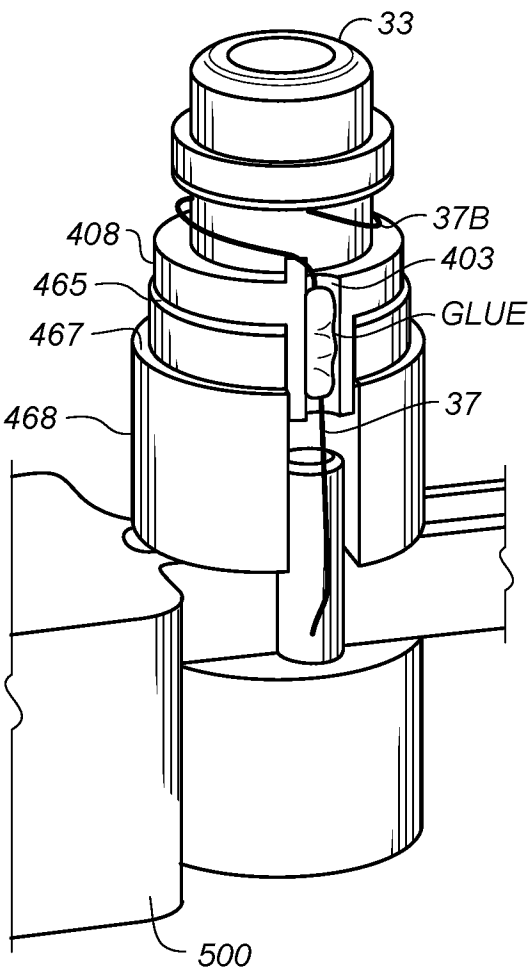
Figure 13A:
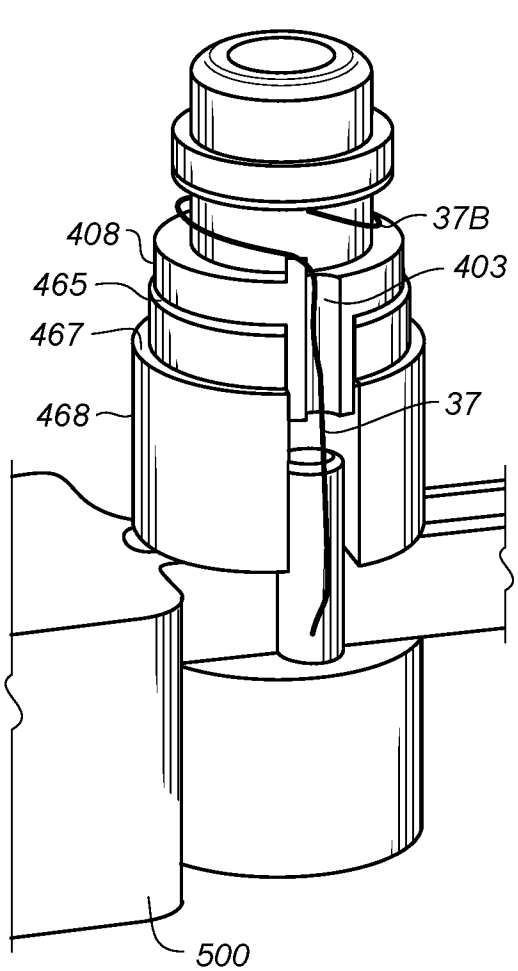
Figure 15:
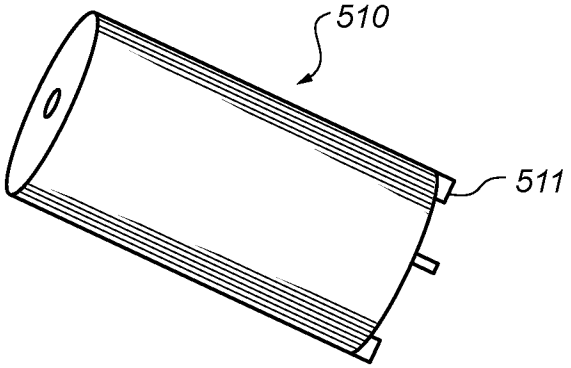
FIG. 15 is a perspective view of the lander device of FIG. 14, in accordance with some examples.
Figure 14:
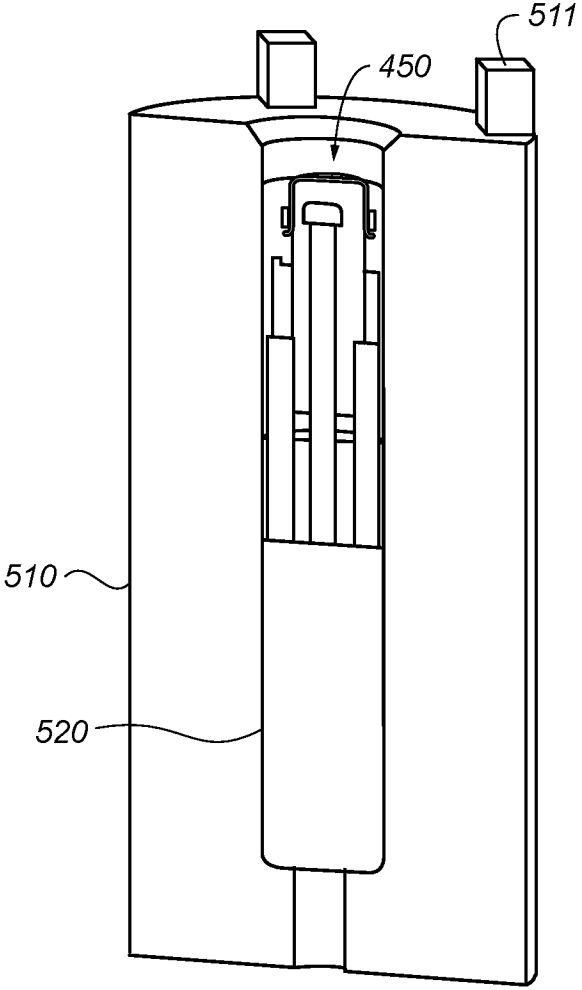
FIG. 14 is a cutaway perspective view of the miniature electro-acoustic transducer assembly and tool of FIGS. 10A-13C positioned in a lander device, in accordance with some examples.
Figure 16A:
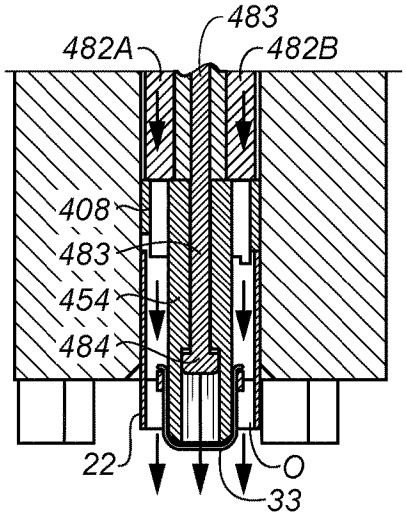
Figure 16B:
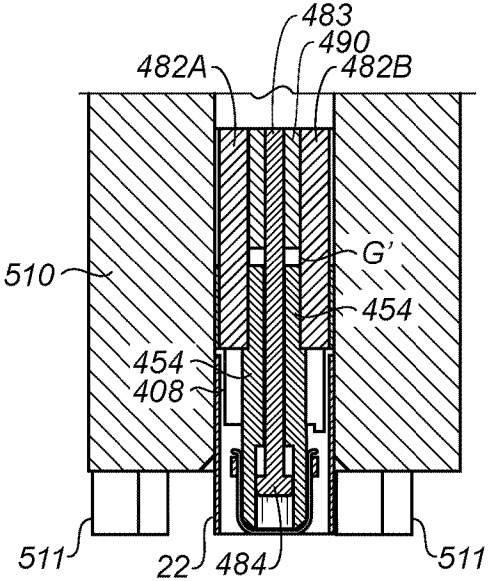
Figure 16:
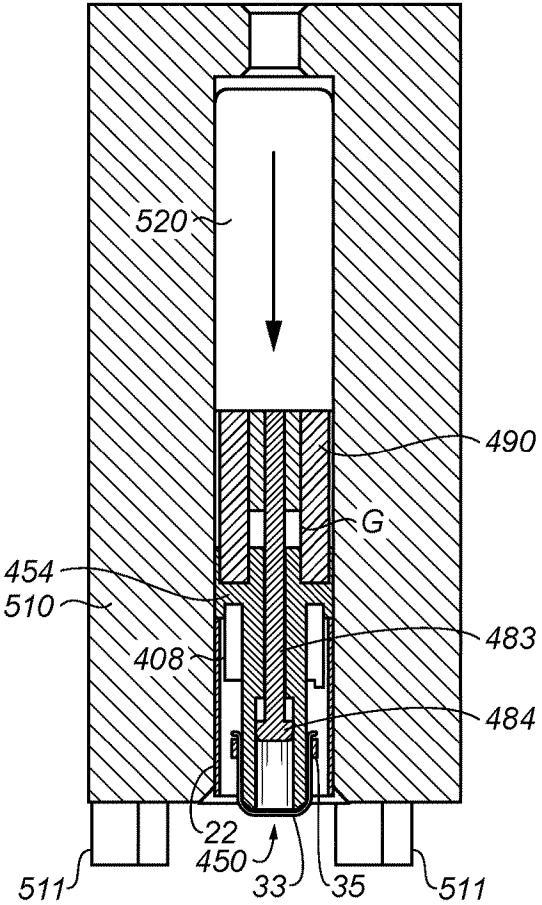

FIGS. 16, 16A, and 16B are cross-sectional front views of components of the miniature electro-acoustic transducer assembly of FIGS. 10A-15 aligned in the lander of FIGS. 14 and 15, in accordance with some examples.

Figure 16C:
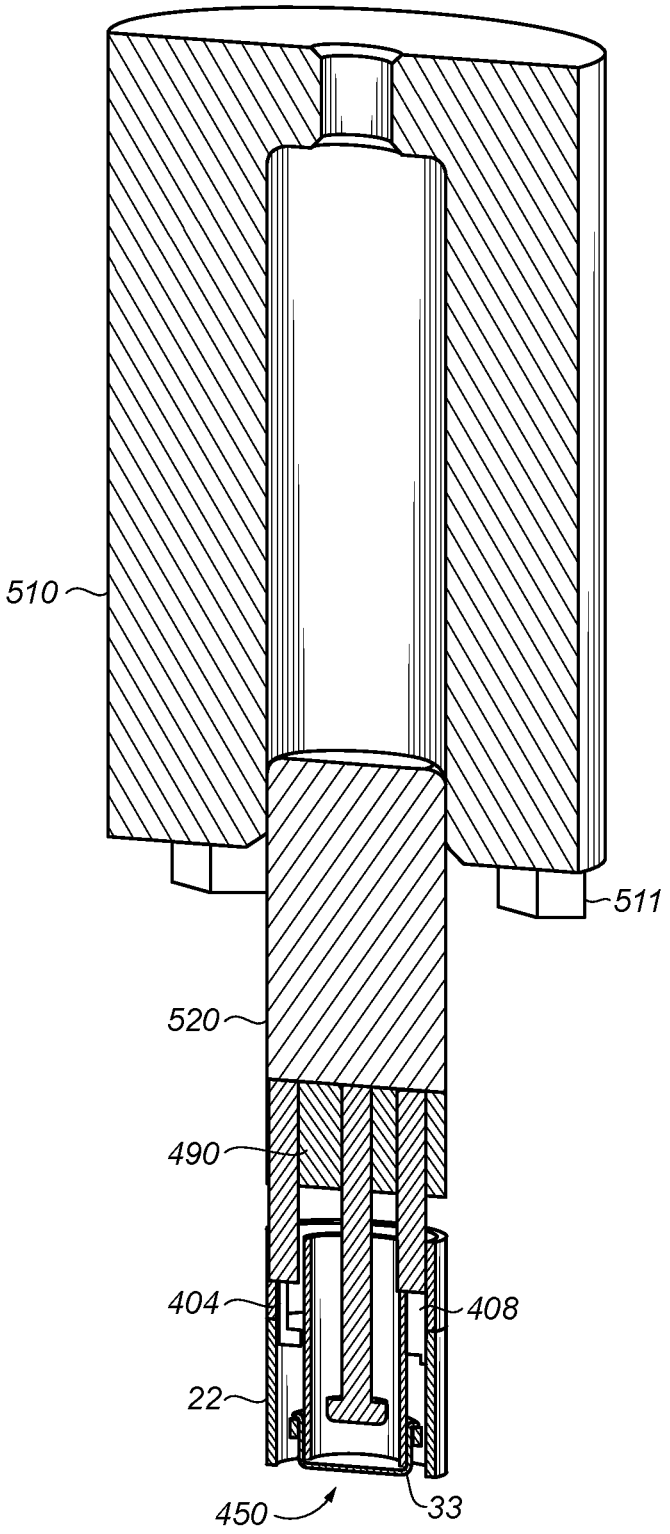

FIG. 16C is a cross-sectional front view of the miniature electro-acoustic transducer assembly of FIGS. 10A-16B removed from the lander of FIGS. 14-16B, in accordance with some examples.

Figure 18:
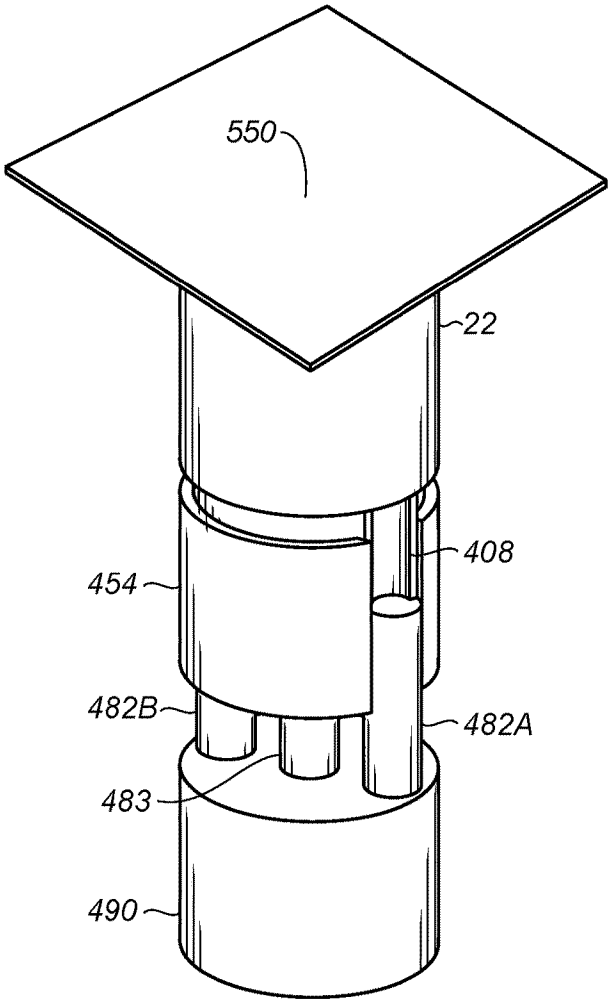
Figure 17:
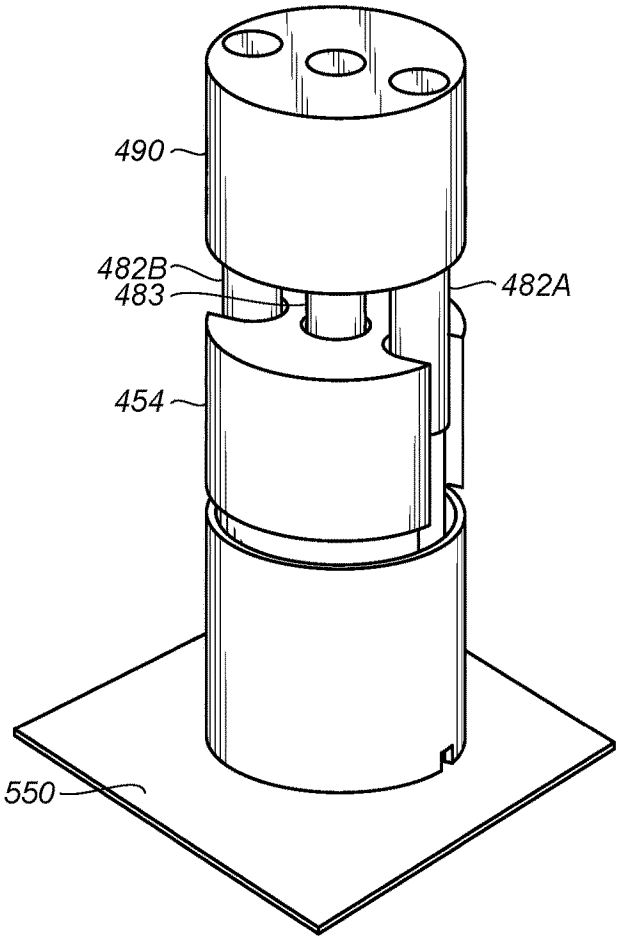

FIGS. 17 and 18 are perspective views of the miniature electro-acoustic transducer assembly and tool assembled in the lander of FIGS. 14-16B arranged for a trim operation, in accordance with some examples.

Figure 20:
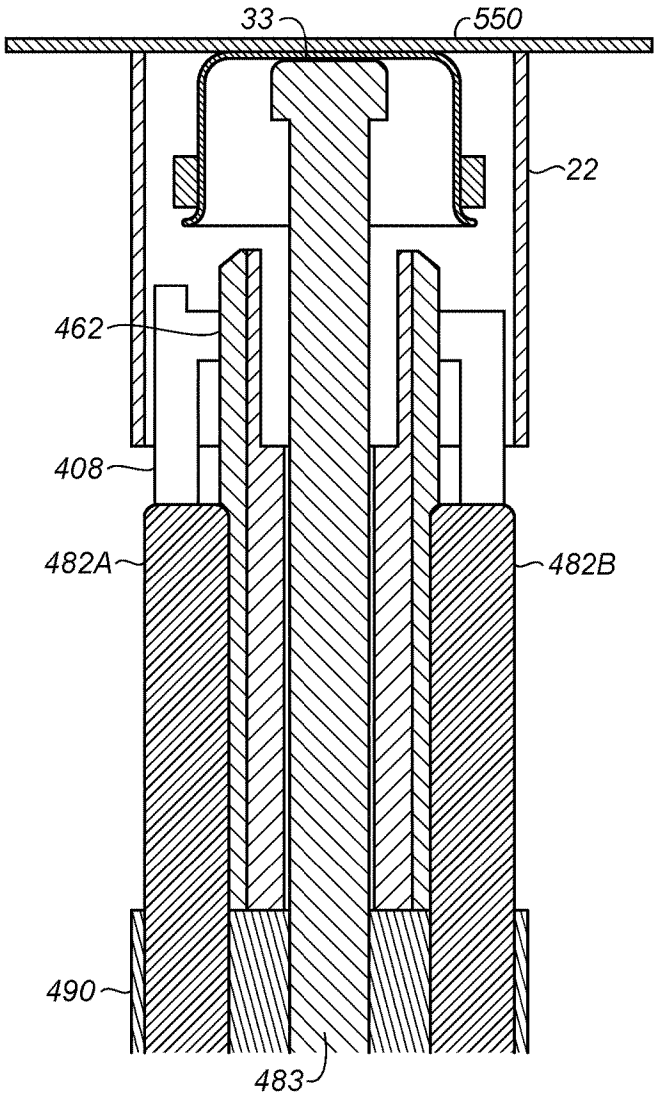
Figure 19:
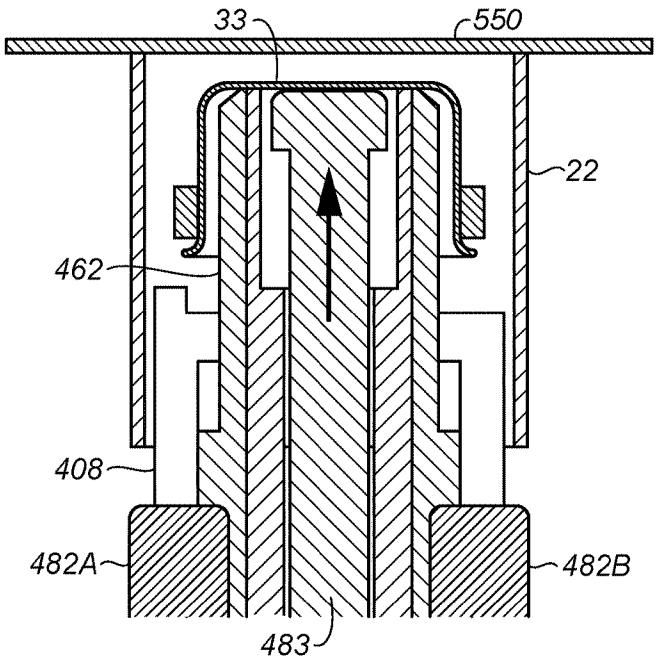

FIGS. 19 and 20 are cross-sectional front views of the miniature electro-acoustic transducer assembly and tool of FIGS. 10A-18, and illustrating a method step where the miniature electro-acoustic transducer assembly is ejected from the tool, in accordance with some examples.

FIGS. 21-24 illustrate a pick and place procedure, in accordance with some examples.

Figure 25:
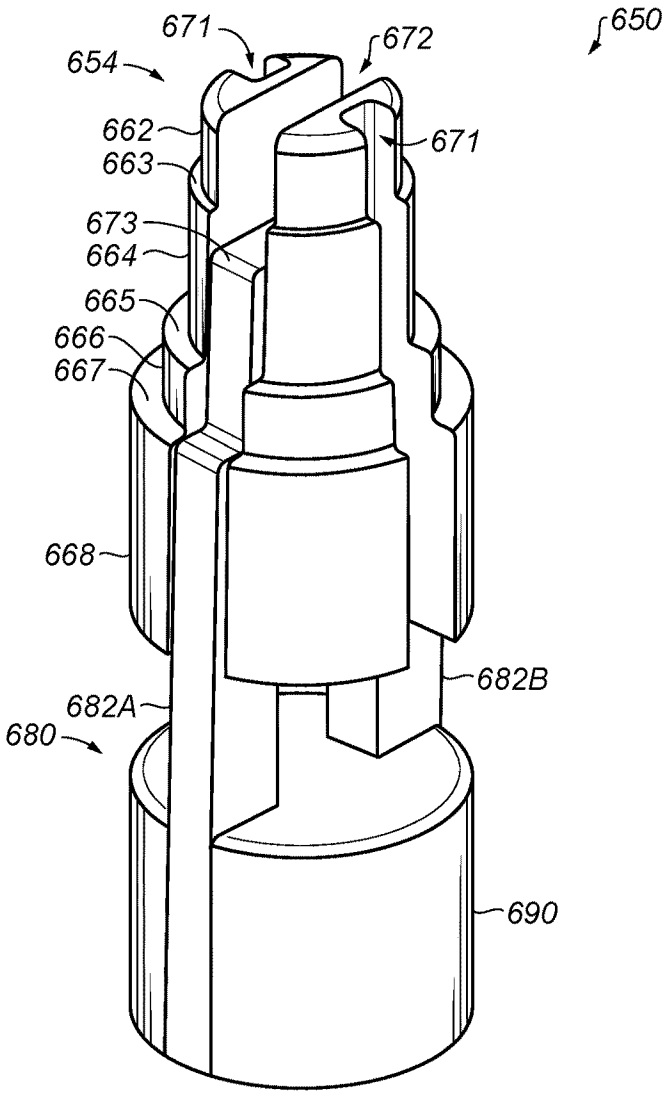

FIG. 25 is a perspective view of a tool for assembling an electro-acoustic transducer, in accordance with other examples.

FIGS. 26-32 are perspective views of method steps for assembling an electro-acoustic transducer using the tool of FIG. 25, in accordance with some examples.

DETAILED DESCRIPTION

Modern in-ear headphones or earbuds typically include a microspeaker, also referred to as a miniature electro-acoustic transducer or driver. A voice coil drives the diaphragm to vibrate. In doing so, the diaphragm pushes the air around it, which in turn creates a sound that is output to a user.

A typical voice coil is configured to receive electrical signals from a printed circuit board (PCB) via contacts or terminals by electrically conducting lead wires thereof to the contacts or terminals. To achieve this, a typical voice coil used in a microspeaker includes leadouts that extend from the voice coil to the contacts or terminals at the transducer sleeve, which in turn are conductively connected directly or indirectly to the PCB.

The formation of a conventional miniature voice coil and the constraining of voice coil wire in the housing, or sleeve, in an earbud transducer is difficult, and requires complicated tooling and manufacturing procedures. In particular, in order for the leadouts of the conductive wires to extend from the voice coil for attachment to a circuit board or the like, the region of coil wire between the voice coil windings and sleeve wall is typically supported by intermediate wire bonding points at the diaphragm or surround, requiring additional complexity in the assembly process.

Figure 1:
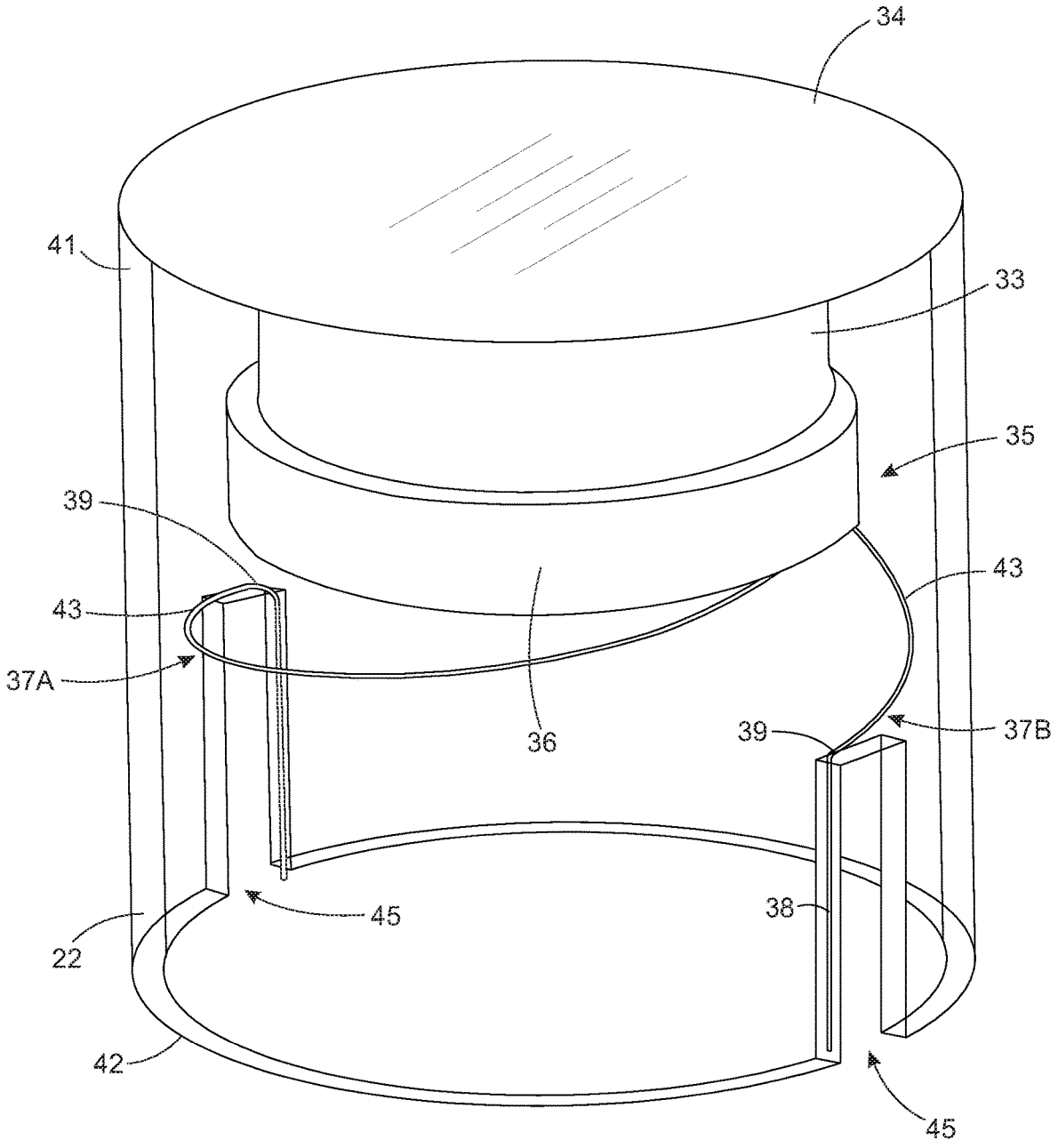
FIG. 1 is a perspective view of an electro-acoustic transducer (excluding a magnet and back plate) exposing an interior of the transducer, according to some examples.

Referring to FIG. 1, an electro-acoustic transducer comprises a miniature voice coil 35 comprising a pair of helicoidal leadout regions 37A, B at the ends of a conductive voice coil wire 35. The leadout regions 37A, B may include connection portions (not shown) at their distal ends respectively so that the leadout regions 37A, B may be electrically connected to lead wires or other conductive connectors. The electro-acoustic transducer may also include but not be limited to a sleeve 22, a magnet assembly (not shown in FIG. 1) and an electrically insulated cylindrical bobbin 33. The sleeve 22 may have a first end 41 and a second end 42. The bobbin 33 may be coupled to a diaphragm 34 positioned about an opening or cavity of the sleeve 22, for example, at or near the first end 41. Although not shown, a cover or other acoustically transparent element providing mechanical protection may be positioned over the diaphragm 34. A printed circuit board (PCB) (not shown) may be positioned at or near the second end 42 of the sleeve 22 opposite the first end 41 to provide contact pads to which the ends of the leadout end regions 37A, 37B may be soldered or otherwise coupled.

The voice coil 35 includes a main windings region 36 and two leadout regions 37A and 37B. A conductive main body configured as at least one winding 36 positioned about the bobbin 33. The voice coil 35 may be formed of copper wire or and/other conductive material. The two ends of the voice coil 35 include a first leadout end region 37A and a second leadout end region 37B, which are constructed and arranged to provide electrical connections to the voice coil 35. In some examples, the conductive wiring forming the windings 36 and leadout end regions 37A, 37B of the voice coil 35 is about 30 microns in diameter, but not limited thereto. The electrical connections provided by the leadout regions 37A, 37B allow for acceptance of electrical signals or may be imparted through the PCB or the like (not shown). The electrical signals provided to the voice coil 35 create the force required to move the diaphragm inward or outward relative to the magnet, or magnetic circuit.

The first and second leadout end regions 37A, 37B, in particular, helical portions 43 of the leadout end regions 37A, B, respectively, for example, forming a 180 degree helix of the leadout end regions 37A, 37B, may extend tangentially from the windings 36 of the voice coil 35, i.e., the portion of the voice coil 35 having a helicoidal configuration, in a direction away from the bobbin 33. In addition to the helical portions 43, each of the leadout end regions 37A, 37B may include a helix, for example, 180 degree turn, and also include a bend 39, for example, 90 degree bend, and a straight portion 38 at a distal end of the leadout end regions 37A, 37B. In some examples, the leadout end regions 37A, 37B, more specifically, the bend portions 39 are constructed and arranged to extend from the sleeve 22 during assembly via openings, recesses, or slots, referred to as wire exit recesses 45, for example, spaced apart 180 degrees as shown.

The leadout end regions 37A, 37B may be freely suspended as shown, i.e., not bonded to the surround but instead occupying a space between the voice coil 35 and the first end 41 of the sleeve 22. Accordingly, the first leadout region 37A and the second leadout region 37B may extend along a same axis, but not limited thereto. In some examples, the wire exit recesses 45 may be spaced apart 90 degrees, 120 degrees, 150 degrees, and so on about the circumference of the first end 41 of the sleeve 22.

Figure 9:
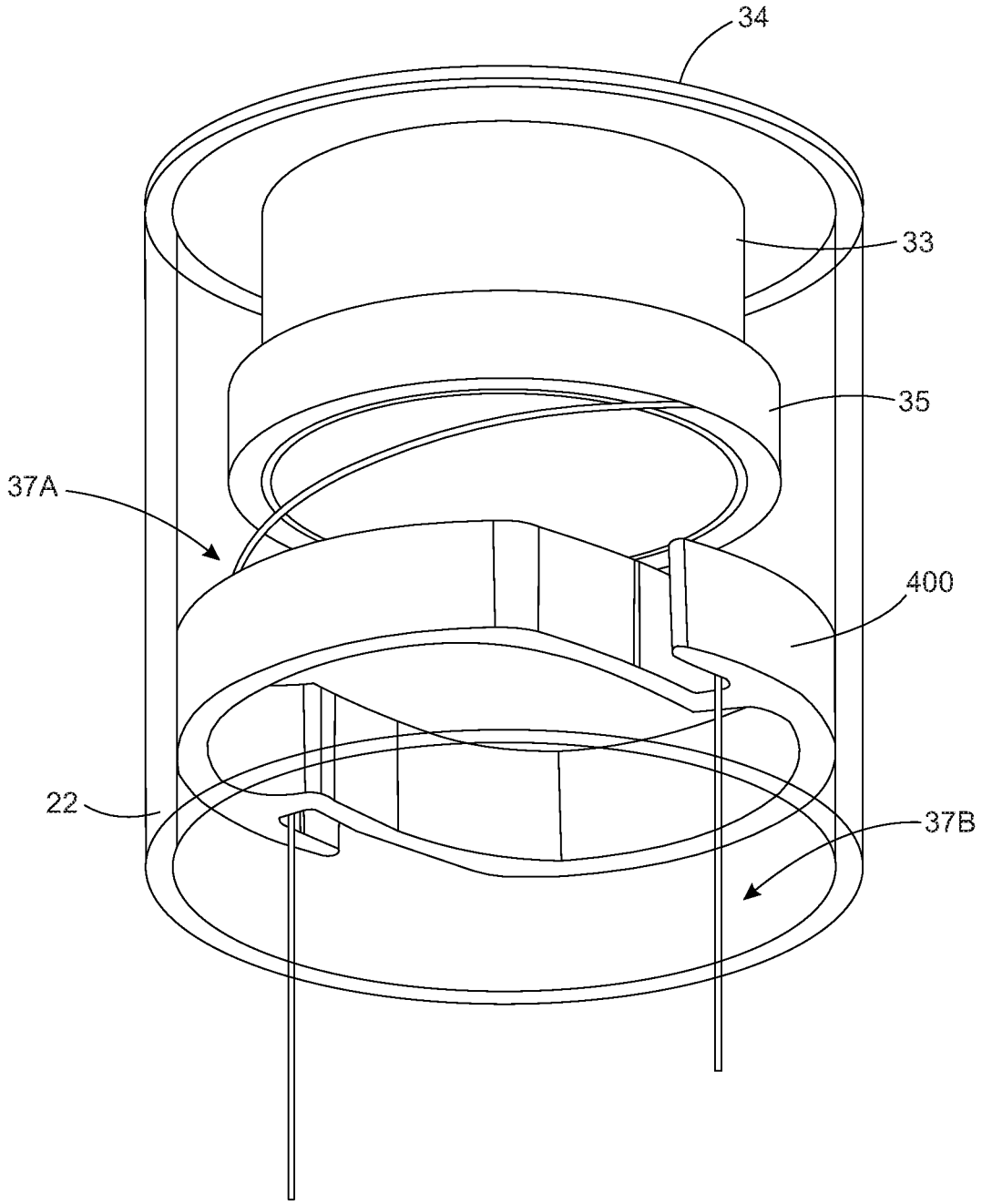
FIG. 9 is a perspective view of an electro-acoustic transducer (excluding a magnet and back plate) and including a gluing ring exposing an interior of the transducer, according to some examples.

In brief overview, the leadout regions 37A, 37B (generally, 37) of an electro-acoustic transducer shown in FIG. 1 or 9 may be formed by a voice coil leadout forming tool, with an objective of automating leadout forming and assembly, and also providing an alignment function. In some examples, the tool is constructed and arranged for positioning at an inner diameter of the bobbin in order to form desired helical-shaped voice coil leadout configurations for microspeaker applications.

Figure 2:
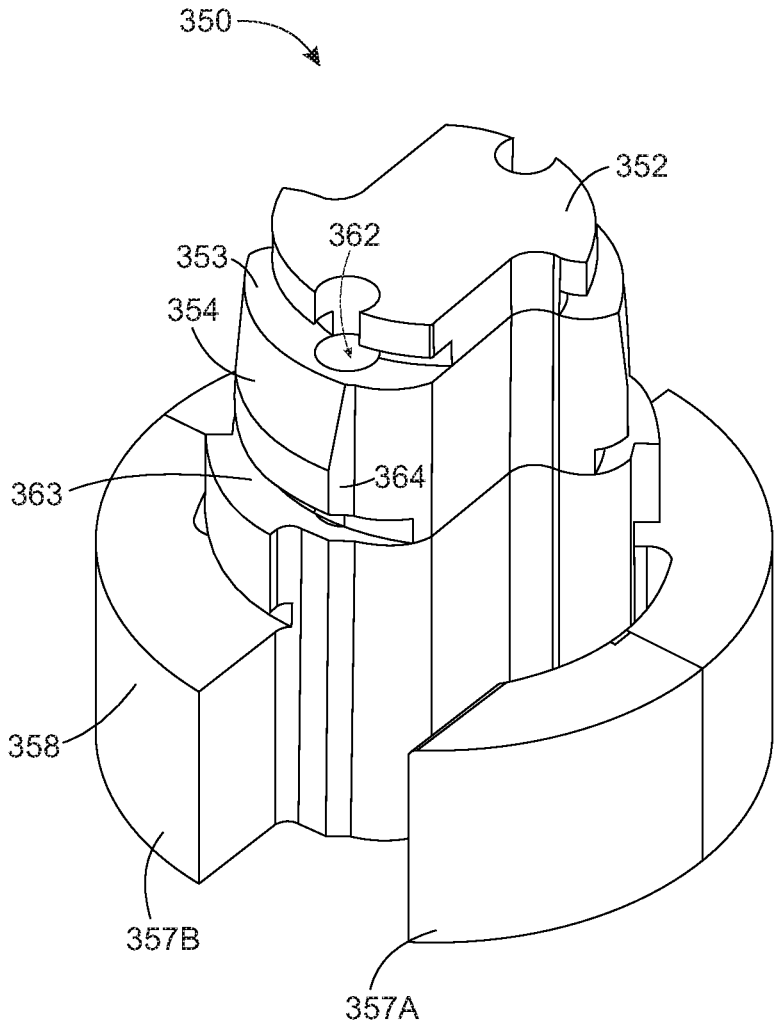
FIG. 2 is a perspective view of a tool for positioning voice coil leadouts when assembling a microspeaker, in accordance with some examples.

Referring to an example illustrated at FIG. 2, an alignment tool 350 comprises a bobbin alignment feature 352, a mandrel 354, and a sleeve alignment element 358. In some examples, the bobbin alignment feature 352, mandrel 354, and sleeve alignment element 358 are formed, for example, molded or machined, of a single stock of material. In other examples, the bobbin alignment feature 352, mandrel 354, and sleeve alignment element 358 are formed separately, and coupled together by bonding or other coupling technique.

The bobbin alignment feature 352 is constructed and arranged for receiving a bobbin 33, and for positioning in an interior of the bobbin 33, and for aligning or centering the bobbin 33 during a subsequent helix formation operation. As shown in FIGS. 4A and 4B, the mandrel 354 is configured to receive a gluing ring 400 shown in FIGS. 3A-3C, constructed and arranged for providing guide paths for distal ends of the helicoidal leadout regions 37 extending in a direction from the mandrel 354 to the sleeve alignment element 358. The mandrel 354 may have a non-circular shape, for example, shown in FIG. 2, for simplifying a manufacturing of the gluing ring 400 and mating with the non-circular rotation-locking feature of the gluing ring 400, for example, a non-circular opening functioning as a rotation-locking feature, whereby the gluing ring 400 is prevented from rotating around the tool 350. In other examples, for example, shown in FIG. 6B, the mandrel 354 includes guide pins 359, for example, cylindrical pins, that contribute to anti-rotation. In configurations where the mandrel has a circular shape, the guide pins 359 are imperative for preventing rotation. In some examples, the bobbin alignment feature 352 has a non-circular shape, for example, to prevent interference with the gluing ring 400 during positioning of the ring 400 about the tool 400. This permits the gluing ring 400 to be positioned about the tool 350. Also, an ejection mechanism, for example, shown in FIG.8, may be applicable, because when the bobbin 33 and coil 35 are inserted, the ejection mechanism is used to apply a force to release these components from the centering section of the tool.

As described herein, the voice coil 35 and bobbin 33 are fixed to the tool 350 so that only the leadout wiring is rotated relative to the stationary voice coil 35 and bobbin 33 about the tool 240 to form the helices. In some examples, the bobbin alignment feature 352 includes a rotation control mechanism that controls a rotation of the bobbin 33 and voice coil 35, the leadout wiring is stationary while the voice coil 35 rotates. For example, the bobbin alignment feature 352 may freely rotate about the top surface 353 of the mandrel 354, for example, by a pin or the like coupling to the bobbin alignment feature 352 and extending through, and rotatable in, a hole in the center of the top surface 353. Thus, during an operation, the bobbin 33 and voice coil 35 positioned about the bobbin alignment feature 352 may rotate with the bobbin alignment feature 352, which would simplify a leadout formation with respect to piloting the straight portions 38 of the leadout regions 37 through the notches 404 in the gluing ring 400, and forming the helicoidal leadout regions 37 about conical sidewall portions 364 of the mandrel 354. For example, formation of the helicoidal leadout regions 37 may occur by rotating or screwing (rotation of the bobbin and voice coil with a slight upward or downward motion) the bobbin and voice coil support, in lieu of piloting the leadouts directly in the gluing ring notches.

The bobbin alignment feature 352 is coupled to a top surface of the mandrel 354. The exposed top surface 353 of the mandrel 354 not covered by the bobbin alignment feature 352 provides for the bobbin 33 with the coil 35 to be positioned on it during an alignment operation, for example, described herein.

The sleeve alignment element 358 is constructed and arranged for receiving the sleeve 22, and for aligning the sleeve 22 relative to the bobbin 33. The helicoidal leadout regions 37 are formed on the conical regions 364 of mandrel 354 to allow an ejection of the transducer assembly from the top region of the mandrel 354, so that the leadout wires do not interfere with the tool 350, and remain intact during ejection. In other words, the conical shape of the mandrel 354 permits releasing a microspeaker assembly including the bobbin 35 and voice coil 35 from the mandrel 354 without damaging the voice coil wiring. The mandrel 354 may include at least one ejection hole 362, and preferably two ejection holes 362 as show to prevent locking of the part from occurring, for receiving push pins from an ejection device 380, for example, shown in FIGS. 8A-8E. An insert, for example, a gluing ring 400 shown in FIGS. 3A-3C, can be positioned on a perimeter surface 363 of the mandrel alignment portion 358, also referred to as a second surface, and surround the bottom region of the mandrel 354.

The sleeve alignment element 358 includes two extensions 357A, 357B (generally, 357), or wings, each extending from a main body of the sleeve alignment element 358, for example, 180 degrees from each other. The two extensions 357A, 357B are constructed and arranged so that a space 361 or region of separation exists between each extension 357A, 357B and the central part of the tool 350 comprising a single unitary material comprising bobbin alignment feature 352, mandrel 354, and sleeve alignment element 358. In some examples, the extensions 357A, 357B are at the bottom level of the microspeaker sleeve 22, so the sleeve 22 can be inserted on its centering feature about the bobbin insert 352 and mandrel 354.

When the conductive wiring of the voice coil 35, more specifically, a straight portion 38 at a distalmost end of the leadout end regions 37A, 37B, is extended, it is under tension and extends in a horizontal position (see FIG. 5A) relative to the direction of extension of the alignment tool 350. The spaces 361 between the wings 357A, B and central portion of the sleeve alignment element 358, respectively, permit wire tension to be maintained and for being part of the guide paths for the helicoidal leadouts 37A, 37B to be piloted down without interfering with the tool 350.

Figure 3A:
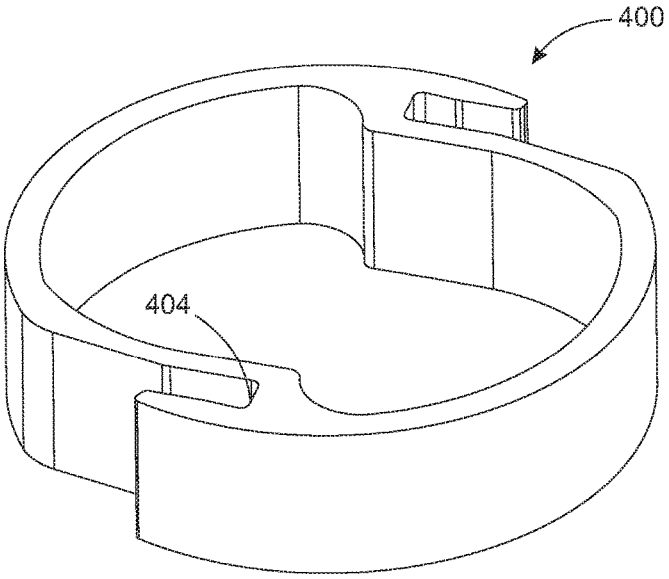
FIG. 3A is a perspective view of a gluing ring, in accordance with some examples.
Figure 3B:
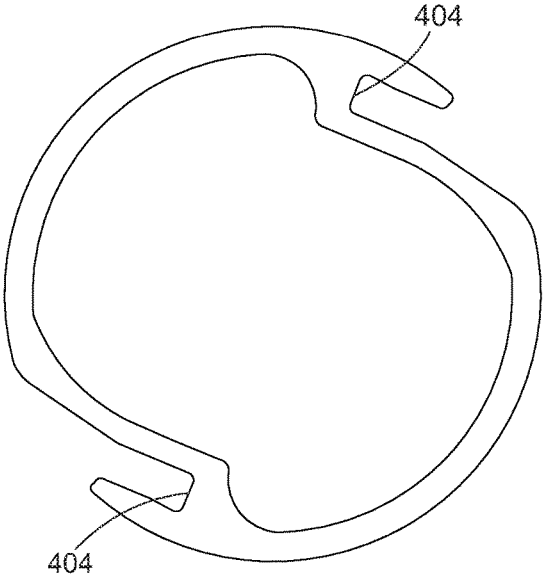
FIG. 3B is a top view of the gluing ring of FIG. 3A.
Figure 3C:
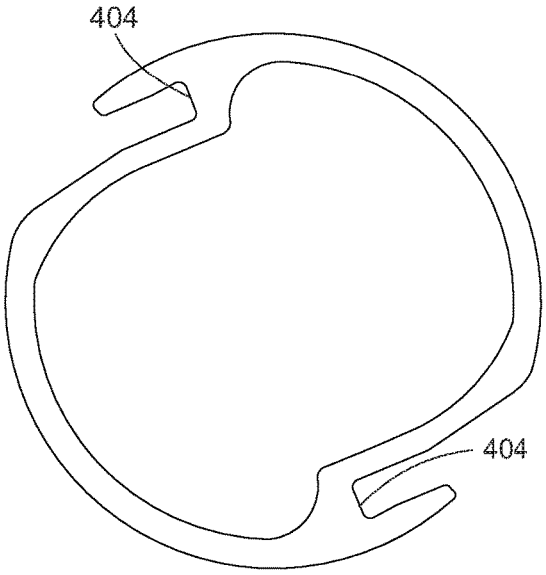
FIG. 3C is a bottom view of the gluing ring of FIGS. 3A and 3B.
Figure 4B:
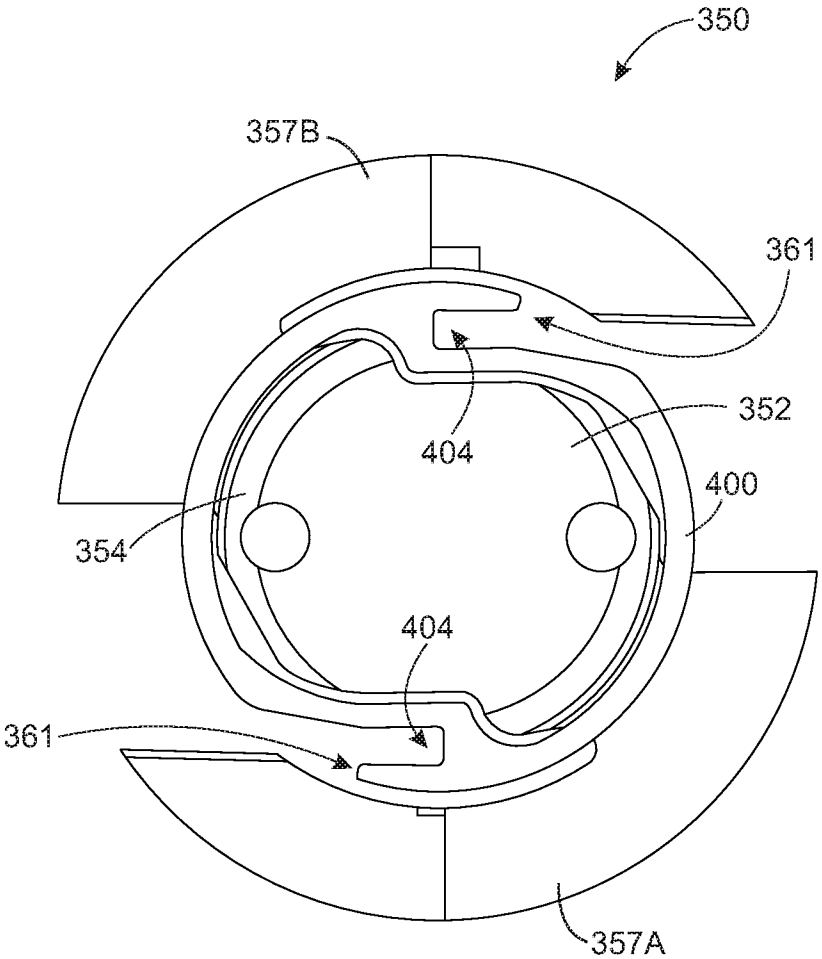
FIG. 4B is a top view of the assembly of FIG. 4A.
Figure 4A:
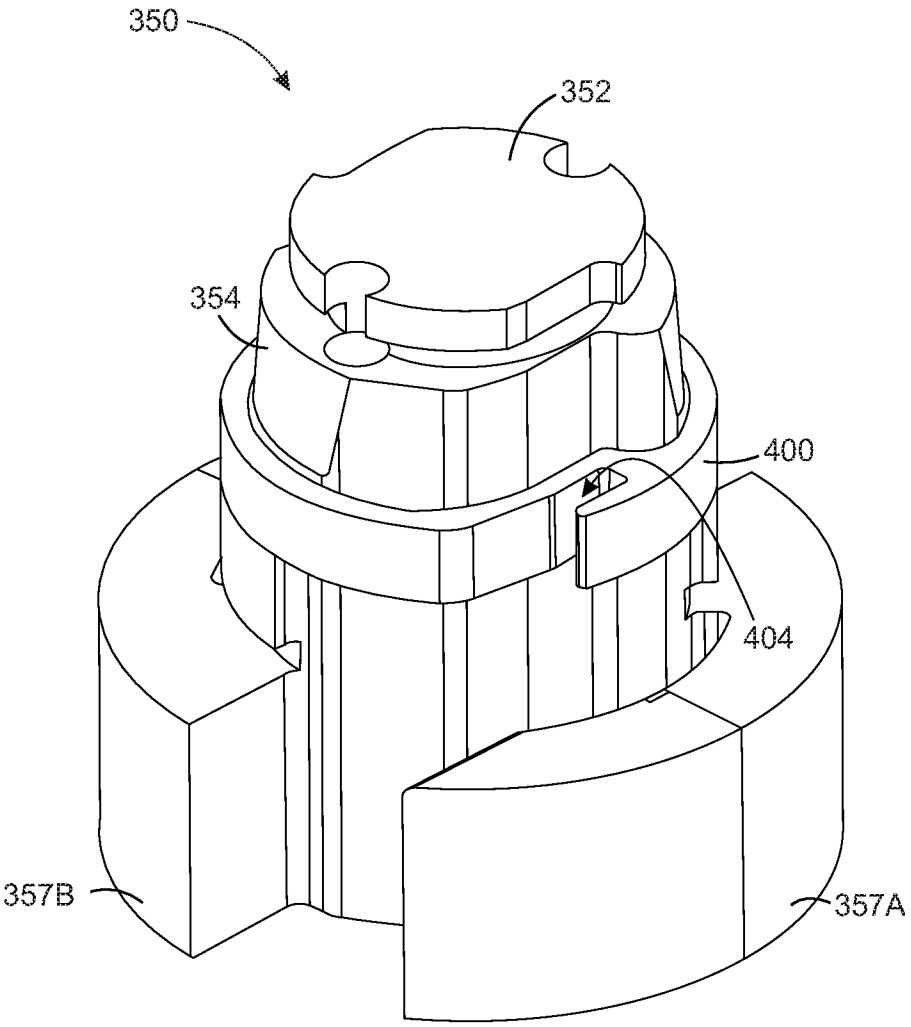
FIG. 4A is a perspective view of an assembly including the gluing ring of FIGS. 3A-3C and the voice coil leadout forming tool of FIG. 2, in accordance with some examples.

A gluing ring 400, as shown in FIGS. 3A-3C, also referred to as an insert, may be constructed and arranged about the tool 350 of FIG. 2, for example, about an outer surface of the mandrel 354, for forming the helicoidal leadout regions 37A, 37B. The gluing ring 400 remains with the transducer assembly for maintaining the helicoidal configuration of the voice coil wiring. The gluing ring 400 may be positioned on the mandrel alignment portion 358 by sliding the ring 400 about the bobbin insert 352 and mandrel 354.

Figure 6B:
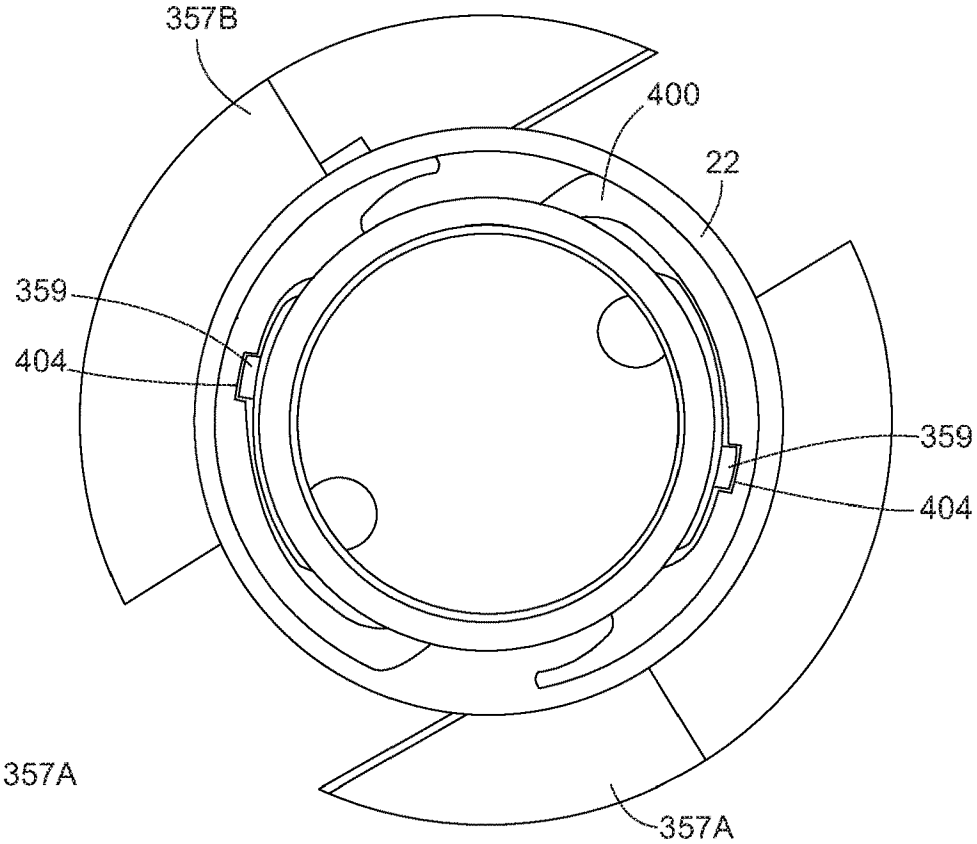
FIG. 6B is a top view of the assembly of FIG. 6A.
Figure 6A:
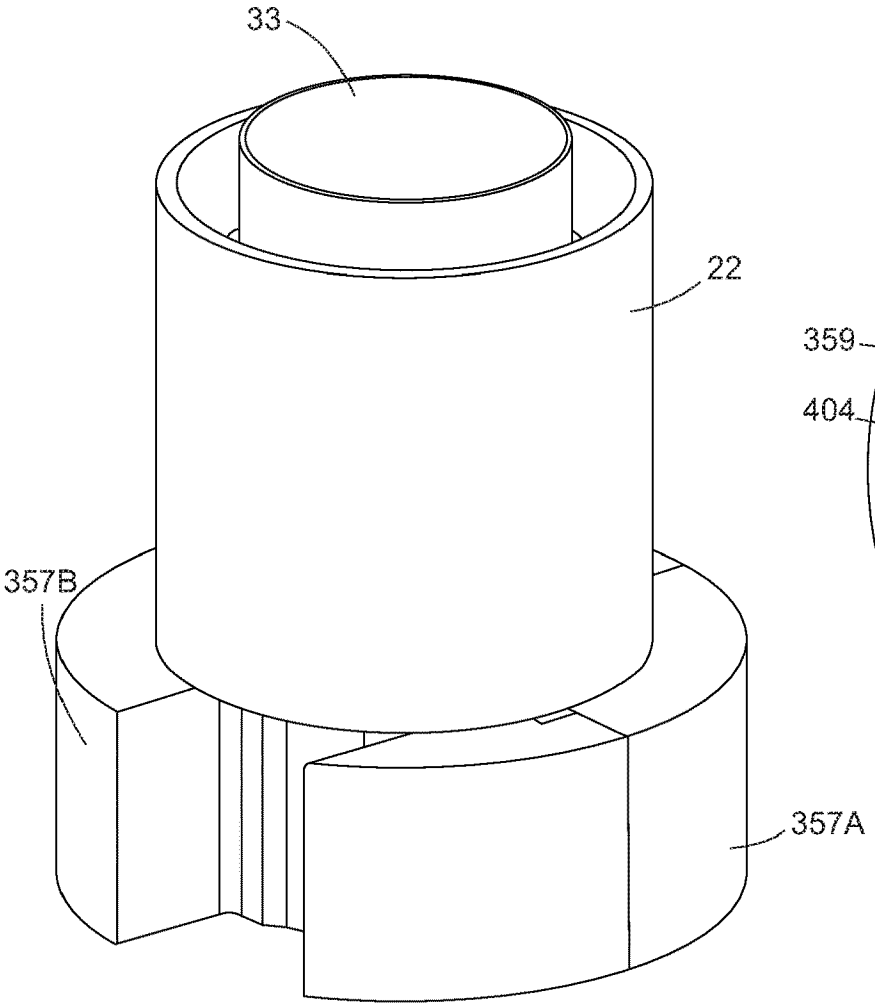
FIG. 6A is a perspective view of an assembly including a housing, bobbin, and voice coil positioned about an assembly, in accordance with some examples.

In some examples, as shown, the opening in the gluing ring 400 has a non-circular shape that allows the gluing ring 400 to include a rotation-locking feature, whereby the gluing ring 400 is prevented from rotating about the tool 350. In other examples where the gluing ring 400 has a circular shape, the gluing ring 400 may include one or more notches, or grooves or the like, that mate with a guide pin extending laterally or otherwise from the mandrel for aligning spaces or notches in the gluing ring 400 with spaces 361 between the wings 357 of the sleeve alignment element 356 and the mandrel alignment portion 358. As shown in FIGS. 6A and 6B, a transducer sleeve 22 can be positioned about the gluing ring 400.

Figure 5A:
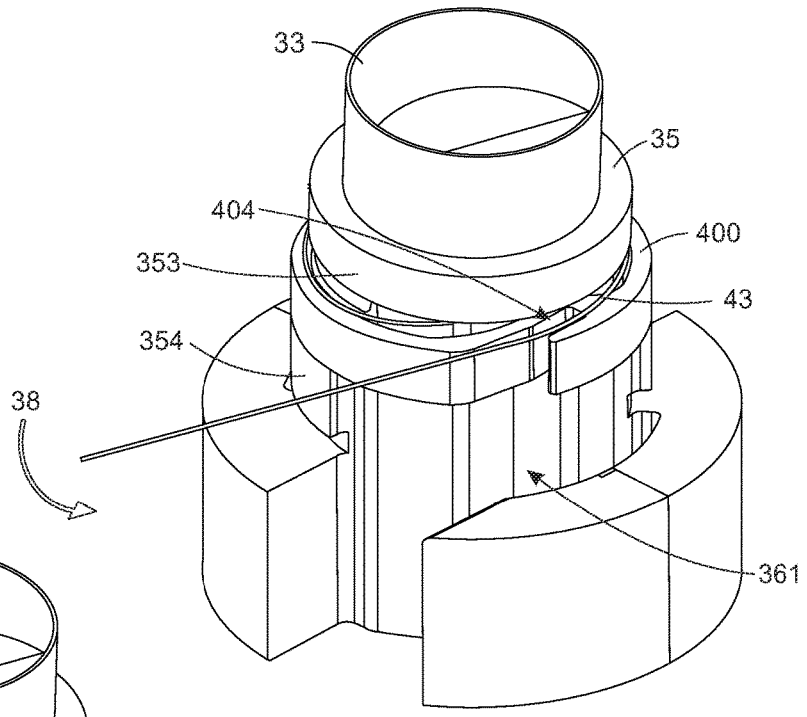
FIGS. 5A and 5B are perspective views of an assembly that includes the alignment tool of FIGS. 2-4B forming a voice coil leadout, in accordance with some examples.
Figure 5B:
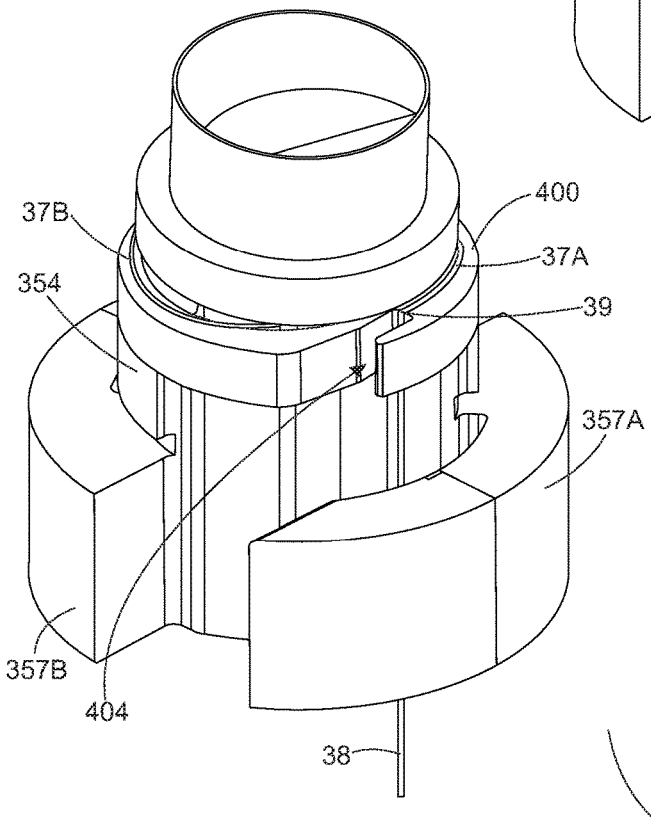
Figure 5C:
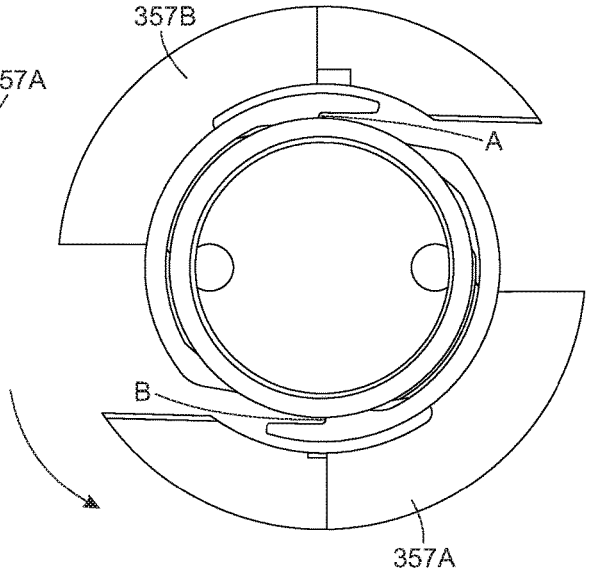
FIG. 5C is a top view of the voice coil leadout forming tool of FIGS. 2-5B forming a voice coil leadout.

As shown in FIGS. 5A-5C, the alignment tool 350 of FIGS. 3A and 3B is positioned at a bobbin 33 and voice coil 35 to form helicoidal leadout regions 37A, B. The bottom surface of the bobbin 33 is positioned on, and directly abuts, the exposed top surface 353 of the mandrel 354 neighboring the bobbin alignment feature 352. Portions of the leadout regions 37A, 37Bof the voice coil 35 are positioned near, and affixed to, insert notches 404 of the gluing ring 400. For example, voice coil conductive wiring where a leadout end region bend 39 is formed at an insert notch 404 (see FIG. 5B) may be glued to each of the two insert notches 404 positioned 180 degrees from each other in the gluing ring 400. During assembly, shown at FIG. 5A, a leadout 37 is moved in a direction of the arrow from a horizontal position (straight portion 38 of the leadout regions 37) to a vertical position shown in FIG. 5B (at bend 39) by inserting the wiring of the windings 36 into the insert notch 404 and the space 361 or region of separation between a wing 357 of the sleeve alignment element 356 and the mandrel alignment portion 358. The regions of separation and central portion permit wire tension to be maintained and forming the guide paths for the distal ends of the helicoidal leadout regions 37.

In some examples, an adhesive such as glue is applied to the wiring of the leadout regions 37 inside the insert notches 404. In some examples, an adhesive is applied to the gluing ring 400 so that a user may pilot the wiring of the leadout regions 37 inside the insert notches 404, and in doing so, the externally applied adhesive is introduced with the wiring of the leadout regions inside the insert notches. In other examples, the adhesive may be applied after piloting the wire in the notch 404, while it is still under tension, for example, using a system to dispense the glue at the notch location. As shown in FIG. 5C, a leadout region 37, in particular, conductive wiring of the leadout region 37, may be glued to the insert notch 404 after a 180 degree rotation. For example, the wiring is piloted down the gluing ring notches 404 and held in place by adhesives, or any clamping mechanism that would contract the notches 404 on the leadout regions 37 and lock or hold them in place. The leadouts 37, in particular, the distal ends 38, are accessible at an end of the sleeve 22 to perform soldering operations to a printed circuit board or the like.

Here, the tool parts do not move, distinguished from other examples herein. Instead of the tool parts moving to form helicoidal leadout regions, in FIGS. 5A-5C, the leadout wiring 36 is piloted about the mandrel 354, and down the gluing ring notches 404 inserted about the mandrel 354. In other examples, the region of the tool, e.g., bobbin insert 352 about which the bobbin 33 and voice coil 35 are positioned is rotatable relative to the mandrel 354.

A method for forming the helicoidal wiring 37 using the tool may begin with a user piloting the leadout wiring of the voice coil 35, for example, manually piloting each of the two leadout wires, and pulling each wire under tension. The tensed wire is wrapped about the conical region of the mandrel 354 to form the helical portions 43. Once a half rotation is formed, i.e., 180°, the end 38 of the leadout wire is still under tension, and aligned with (parallel to) the notch 404 in the gluing ring 400. The user may manually drive the leadout wire down in the gluing ring notch 404, noting that initially the leadout wire is parallel to the gluing ring notch 404 in the previous step, but at the end of this step the end of the leadout wire 38 is orthogonal to the gluing ring notch 404 due in part to a space 361 between a wing 357 of the sleeve alignment element 356 and the mandrel alignment portion 358. In this example, the only parts that move are the 2 leadout wires. The assembly is stationary on the tool 350 due to the shape relationship between the gluing ring 400 and the tool 350 that impedes rotation. The leadout wires 38 are secured in the gluing ring notches 404 using a bonding technique, e.g., adhesive, or clamping, for example, bending or collapsing the gluing ring notches 404 on the leadout wires 38 to form a clamp.

In other examples where the bobbin 33 and voice coil 33 rotate instead of remaining stationary on the tool 350, the leadout wires 38 are instead stationary, and being kept under tension. During rotation of the bobbin 33 and voice coil 35, the voice coil wiring 37 wraps around the conical section of the mandrel 354. After half a turn rotation (180°), the leadout wires are parallel to, or otherwise aligned with, the gluing ring notches 404, then subsequently directed down the gluing ring notches 404, forming a 90 degree bend in the wiring to separate the straight portions 38 from the helical portions 43 of the leadout end regions 37A, B, respectively, and securing the straight portions 38 in place in the notches 404 by adhesives, clamping, and so on.

As shown in FIG. 6A-6B, a sleeve 22 is positioned about the assembly including the bobbin 33, voice coil 35, and gluing ring 400. In particular, the sleeve 22 fits about the alignment portion 358 and rests on the top surface of the wing portions 357A, B of the sleeve alignment element 358. Thus, the sleeve 22 can be centered about the bobbin 33. Preferred examples call for the sleeve 22 to be added to the assembly after the leadouts 37 are formed. For example, after the leadouts 37 are formed and bonded, e.g., using an adhesive outside of the gluing ring 400, the sleeve 22 is inserted. In another example, in lieu of an adhesive, the sleeve 22 and gluing ring 400 may be tightly coupled sufficiently to prevent movement of the gluing ring 400 inside the sleeve 22.

Figure 7A:
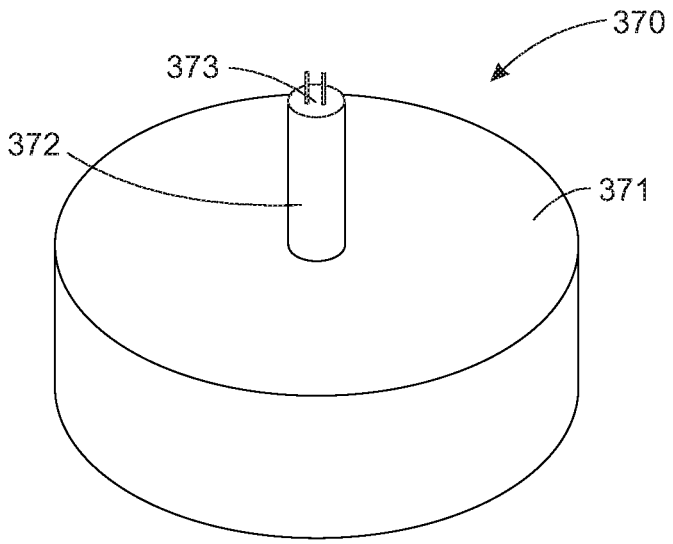
FIG. 7A is a perspective view of a support fixture for a tool, in accordance with some examples.
Figure 7B:
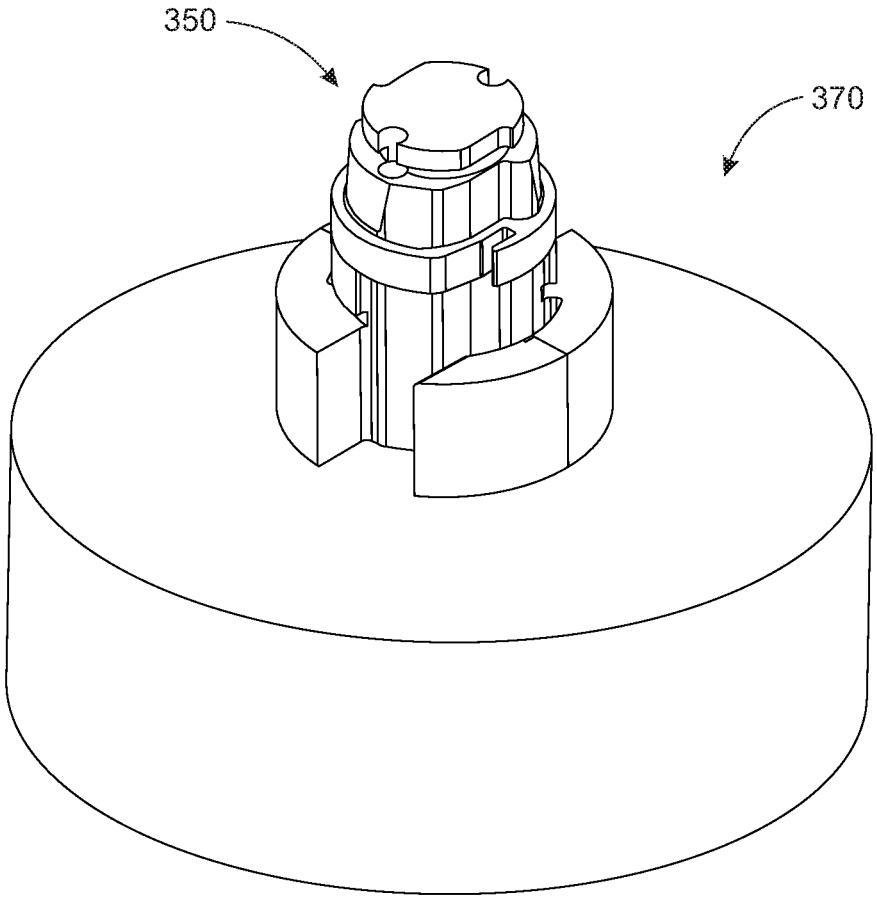
FIG. 7B is a perspective view of a tool positioned at the support fixture of FIG. 7A, in accordance with some examples.

As shown in FIGS. 7A and 7B, a support fixture 370 may be removably inserted into the alignment tool 350 for locking the alignment tool 350 in place to assist with leadout formation and application of adhesive to the leadouts 37. The support fixture 370 may include a base 371 and a central protrusion element 372 that is constructed and arranged for insertion into a hole in the mandrel alignment portion 358 of the tool 350. The base 371 provides stability. The central protrusion element 372 elevates the assembly to simplify manipulation of voice coil wires by a user. In cases where machines are used to form the leadouts, the central protrusion element 372 may not be required. The support fixture 370 may also include a pair of prongs 373 that extend from the central protrusion element 372 which are constructed and arranged for insertion into the ejection holes 362 of the mandrel 354, for locking the tool 350 on the support fixture 370. In other words, the tool is locked and secured on the locking fixture 370 during formation of the leadouts 37. Distalmost ends of the one or more prongs 373 do not exceed past a bottom surface of the bobbin 33 and coil 35. Thus, the prongs 373 on the fixture 370 and ejection device 380 and the through holes on the tool 350 are designed so that the prongs cannot interfere with the wiring, for example, conductive wiring forming the leadouts 37. Although two prongs 273 are shown and described, a single prong 273, or three or more prongs 273, may equally apply.

Figure 8B:
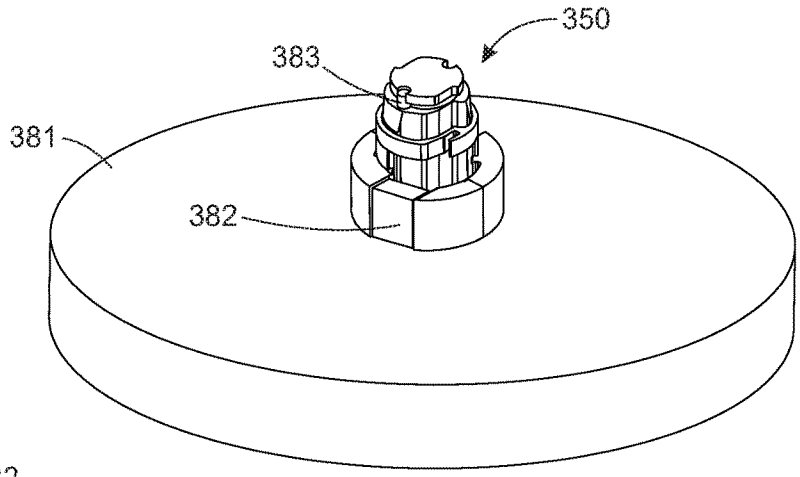
FIG. 8B is a perspective view of a tool positioned at the ejection device of FIG. 8A, in accordance with some examples.
Figure 8C:
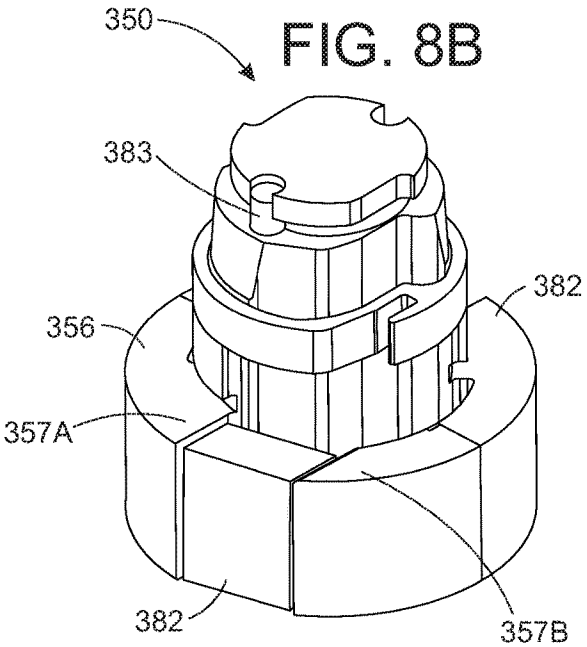
FIG. 8C is another perspective view of a tool positioned at the ejection device of FIGS. 8A and 8B, in accordance with some examples.
Figure 8A:
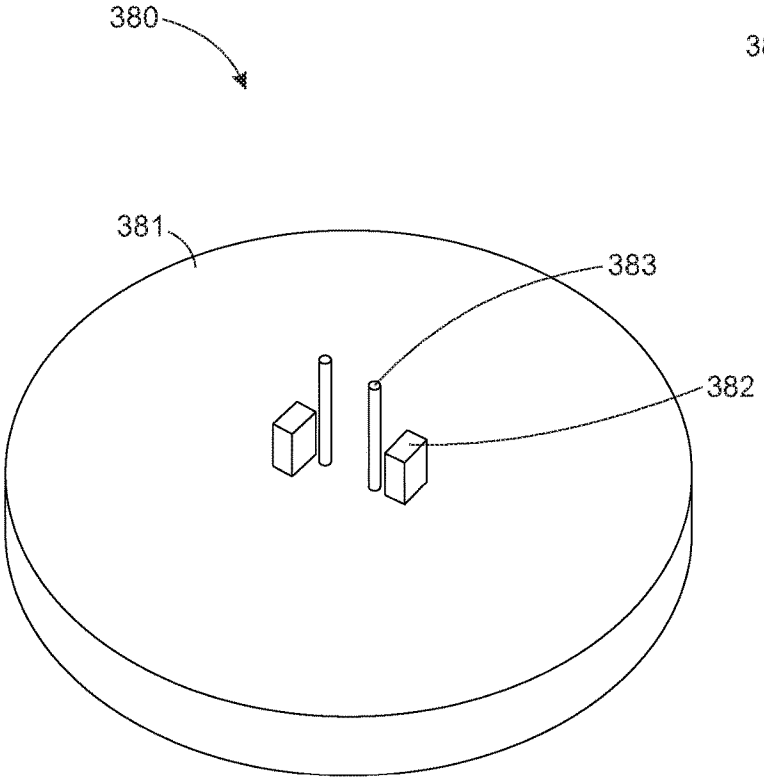
FIG. 8A is a perspective view of an ejection device for a tool, in accordance with some examples.
Figure 8D:
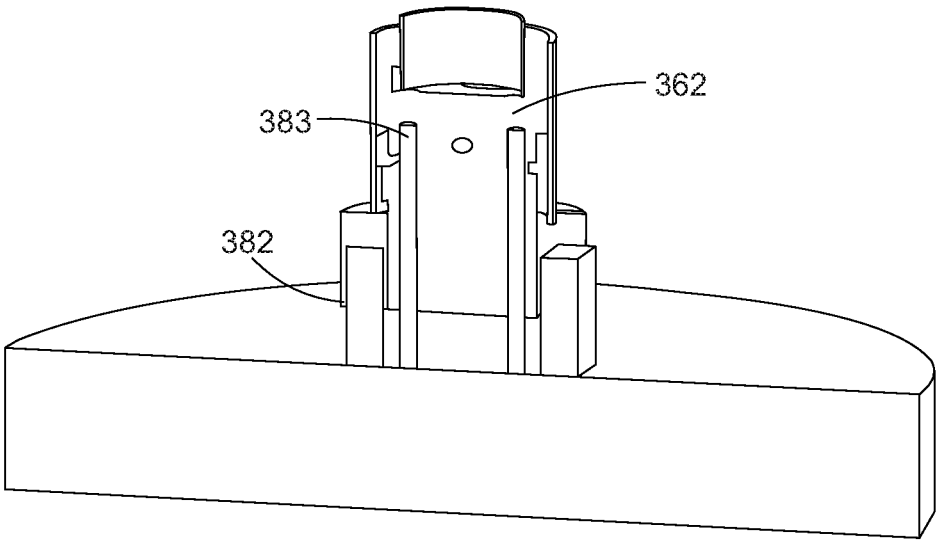
FIGS. 8D and 8E are cross-sectional views of the voice coil leadout forming tool and ejection device of FIGS. 8A-8C in various positions relative to each other.
Figure 8E:
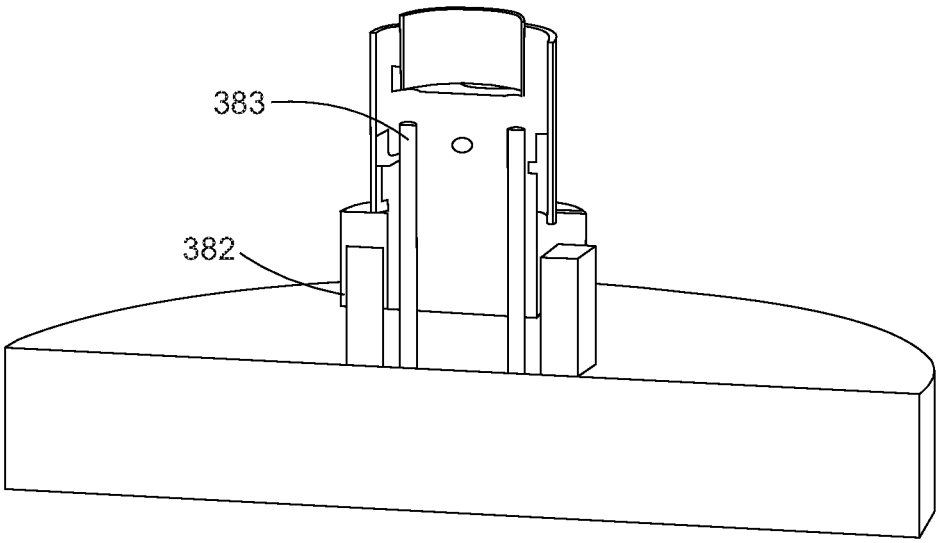

As shown in FIGS. 8A-8E, an ejection device 380 in other examples may be removably inserted into the alignment tool 350 for removing a transducer assembly including the coil 35, bobbin 33, and sleeve 22 from the alignment tool 350. The ejection device 380 may include a base 381 and two base blocks 382 that are constructed and arranged for insertion between the wings 357 of the sleeve alignment element 356. Also, the ejection device 380 may also include at least one cylindrical ejection pin 383 that extends from the base 381 between the base blocks 382, and constructed and arranged for insertion into the ejection holes 362 of the mandrel 354. Although two pins 383, in other examples, a single pin 383 or three or more pins 383 may equally apply. The ejection pins 383 are arranged to not interfere with the helicoidal leadout regions 37A, B during ejection. In FIGS. 8D and E, a force may be applied so that the blocks 382 are inserted into the cavities between the wings 357 to abut the sleeve 22, and simultaneously, the ejection pins 383 are inserted into the ejection holes 362 of the mandrel 354 to abut the bobbin 33. At this time, the device is freed from the tool 350 and can be safely removed without impacting the formed helicoidal leadouts.

FIG. 9 is a perspective view of an electro-acoustic transducer (excluding a magnet and back plate) and including a gluing ring 400 exposing an interior of the transducer. The transducer shown in FIG. 9 may be similar to the transducer shown in FIG. 1 except for the presence of a gluing ring 400, for example, including a bobbin 33, miniature voice coil 35, helicoidal leadout regions 37A, B, and so on. A motor assembly, for example, including a magnet and back plate (not shown), may be inserted into the sleeve 22 to complete the assembly of the electro-acoustic transducer. For example, the back plate may have a first opening for receiving the portions of the conductive wire and a second opening for receiving the second region of the conductive wire. A circuit board may be coupled to an end of the sleeve 22, and end portions 38 of the leadout end regions 37 may extend to the circuit board.

Accordingly, as described herein, a locking mechanism may be provided to manipulate the leadout regions 37 while holding the start position of the leadouts, i.e., the voice coil 35 and bobbin 33 in a pre-rotation position, and end position of the helical leadouts affixed to the gluing ring 400. In other examples, a user may desire to manipulate the assembly on the tool 350 and form a microspeaker with either a two-pass or microfabrication method. In some examples, the release step of the process occurs at the end of assembly, when the transducer has been fully built. Here, the ejection pin and features on the pin like the conical section are relevant to enable releasing the part without damaging the leadouts 37. In a method described above, the method proceeds from a step of presenting the assembly and gluing directly to the release step. However, the method is not limited thereto. In other examples, it is possible to perform additional operations on the subassembly positioned on the tool, for example, subassembly components such as the sleeve, coil with bobbin positioned on the tool by an interference fit due to the inside diameter of the bobbin 33 is very close in dimension to the outside diameter of the centering feature for the bobbin 33.

Examples of an assembly method are suitable because the leadouts may be manipulated before forming the entire assembly, while the leadouts are more easily accessible for manipulation, due at least in part to the parts being stationary on the pin. In some examples, during fabrication, the tool may be positioned on a silicone sheet or a microfabricated suspension and affixed with glue. The sleeve is positioned to be aligned with a surface of the bobbin, and the transducer membrane would be bonded on the sleeve and bobbin interfaces. A feature is that the bobbin and sleeve directly contact the liquid silicone in the same step.

In sum, a locking mechanism in some examples offers two purposes: to locking part on the tool during leadout manipulation and gluing steps and to lock parts on the tool while performing other operations on the subassembly of the parts on the tool, such as bonding the transducer membrane or the like. A mechanism may be applied to reverse a fixing of the subassembly on the tool, such as an ejection mechanism using ejection pins, and/or other release mechanisms.

Figure 10B:
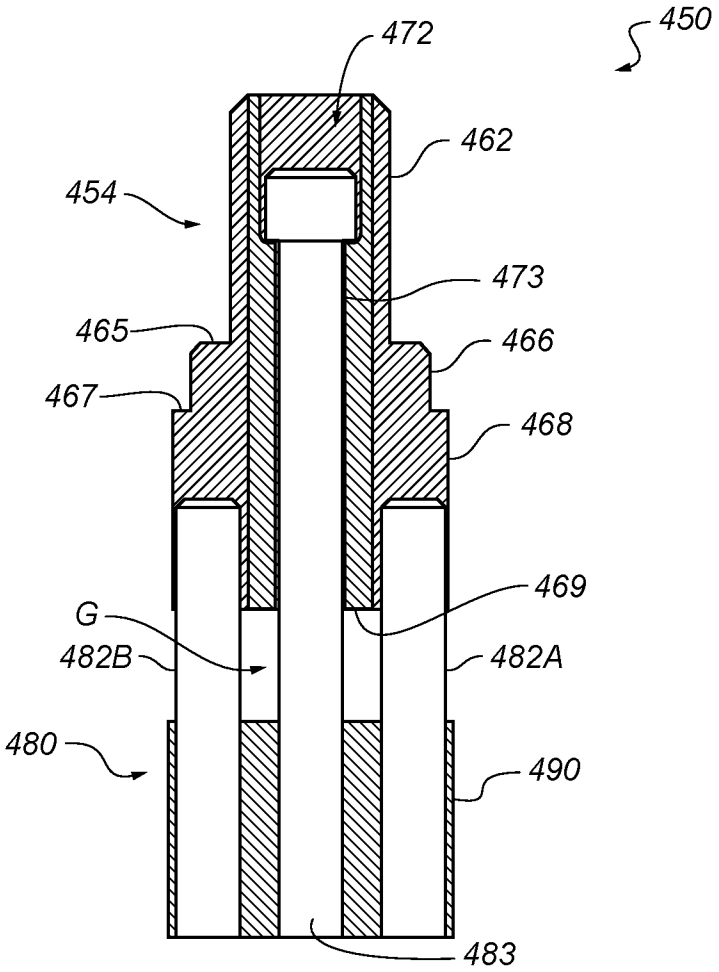
FIG. 10B is a cutaway side view of the tool of FIG. 10A.
Figure 10A:
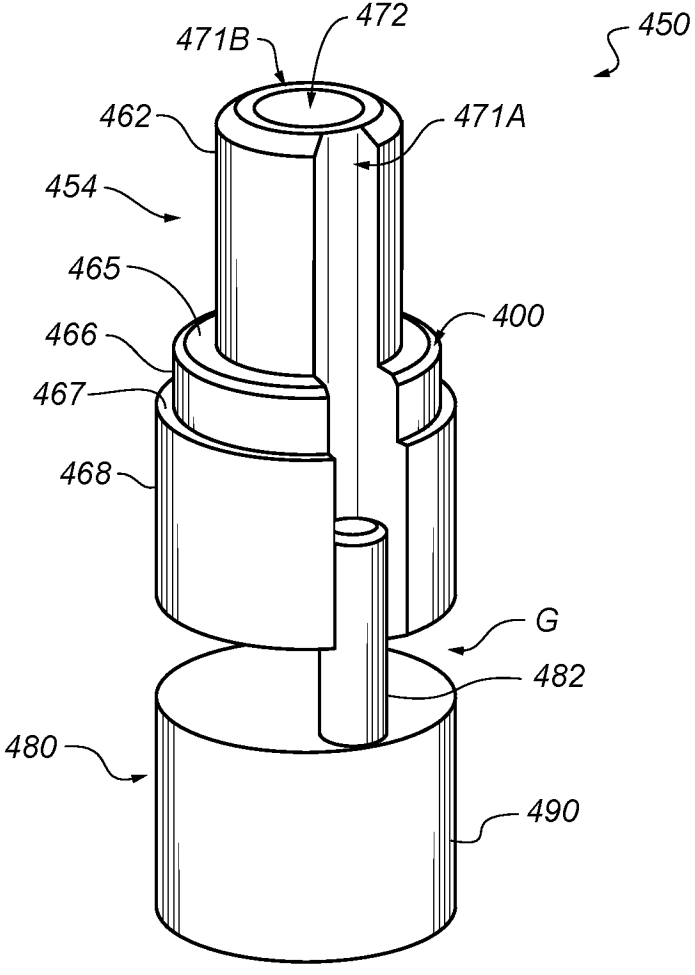
FIG. 10A is a perspective view of a tool for assembling an electro-acoustic transducer, in accordance with some examples.

FIG. 10A is a perspective view of a tool 450 for assembling an electro-acoustic transducer, in accordance with some examples, for example, similar to or the same as the transducer shown in FIG. 1. FIG. 10B is a cutaway side view of the tool 450 of FIG. 10A. The tool 450 similarly is configured to align a voice coil and sleeve for surround assembly, while constraining a leadout during assembly.

The tool 450 comprises a mandrel 454, a bottom element 490 also referred to as a lander core, a first side pin 482A, a second side pin 482B, and a center pin 483. The first side pin 482A, second side pin 482B, and center pin 483 each extends between the bottom element 490 and the mandrel 454 and allows the mandrel 454 and bottom element 490 to move linearly relative to each other, for example, to change a dimension of a gap (G) between the mandrel 454 and the bottom element 490.

The mandrel 454 comprises a bobbin alignment feature 462, a sleeve alignment feature 466, and a base portion 468. In some examples, the bobbin alignment feature 462, sleeve alignment feature 466, and base portion 468 are formed, for example, machined from a single stock of material such as steel, or formed by microinjection molding or other relevant technique. In other examples, the bobbin alignment feature 462, a sleeve alignment feature 466, and/or base portion 468 are formed separately, and coupled together by bonding or other coupling technique.

The bobbin alignment feature 462 is constructed and arranged at an upper region of the mandrel 454 for receiving a bobbin 33 and voice coil 35 (see FIGS. 12A and 12B), and for positioning in an interior of the bobbin 33, and for aligning or centering the bobbin 33 during a subsequent operation that includes the formation of helicoidal leadout regions at the ends of a conductive voice coil wire 35, for example, shown at FIG. 13A. The bobbin 33 preferably has a dome or related top surface in order for the tool 450 to operate properly when assembling an electro-acoustic transducer.

The bobbin alignment feature 462 is constructed and arranged for receiving an insulative ring 408, also referred to as a cylindrical circuit, which is positioned on a lip 465 or the like between the bobbin alignment feature 462 and the sleeve alignment feature 466, and is spaced from the bobbin 33 by the bobbin alignment feature 462 as shown in FIGS. 12A and 12B.

The sleeve alignment feature 466 has a width or diameter greater than the bobbin alignment feature 462, and therefore forming the lip 465 or the like that extends from the outermost circumference of the sleeve alignment feature 466.

The base portion 468 has a width or diameter greater than the sleeve alignment feature 466, and therefore includes a lip 467 or the like that extends from the outermost circumference of the sleeve alignment feature 466. The sleeve 22 (see FIG. 13C) can be positioned over the sleeve alignment feature 466 and rests on the lip 467 in a manner that provides for alignment between the sleeve 22 and the bobbin 33 and voice coil 35.

The mandrel 454 includes a hole 472 through its center axis, in particular, through the bobbin alignment feature 462, sleeve alignment feature 466, and base portion 468, for receiving the center pin 483 of a lander core device 480. The mandrel 454 also includes first and second side grooves 471, which are parallel the hole 472 and likewise extend through the bobbin alignment feature 462, sleeve alignment feature 466, and base portion 468. As shown, the lander core device 480 includes a bottom element 490 from which the center pin 483 and two side pins 482 extend. The lander core device 480 is constructed and arranged to conform with the various sections of the mandrel 454, for example, the side pins 482 aligning with the base portion 468 of the mandrel 454. The opening 472 and side grooves 471 of the mandrel 454 are of a dimension allowing the mandrel 454 to move linearly, e.g., up and down, relative to the lander core device 480 and bottom element 490. The bottom element 490 may be cylindrical, and include side grooves or the like for receiving and coupling to the side pins 482. The pins 482, 483 may be press-fit, glued, or otherwise tightly coupled inside holes in the bottom element 490.

Figure 11:
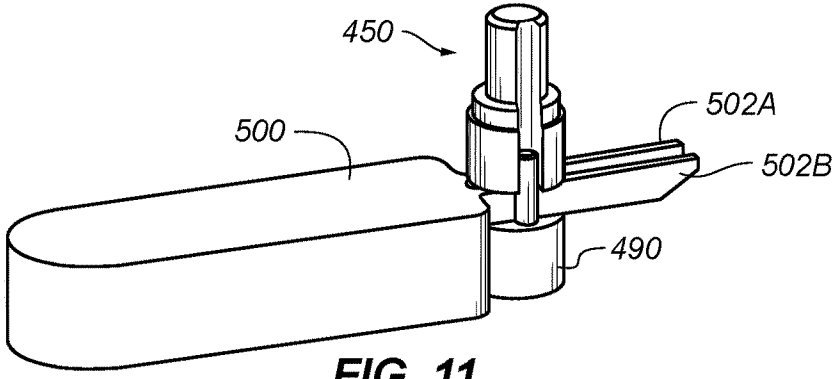
FIG. 11 is a perspective view of a load holder device inserted into the tool of FIGS. 10A and 10B, in accordance with some examples.

As shown in FIG. 11, a load holder device 500 can be inserted into a gap (G) between the mandrel 454 and the bottom element 490, and between side pins 482 to increase a dimension of the gap (G). The load holder device 500 includes first and second legs 502A, 502B, also referred to as "lift fingers," extending in the gap (G) between either side of the center pin 483. In doing so, the center pin 483 is centered between the lander legs 502A, 502B, and fills the gap (G). The load holder device 500 may be operated manually, or coupled to a machine such as a robotic apparatus, in each case holding the base of the load holder device 500 for moving the tool 450 and bobbin 33 and voice coil 35 of the electro-acoustic transducer, for example, loading the tool 450 into a robot end of arm tooling (EoAT) apparatus, for example, EoAT apparatus 710 shown in FIG. 30.

Also, as shown in FIG. 12B, a bottom surface of the mandrel 454 directly abuts a surface of the load holder device 500, and in doing so, the mandrel 454 moves linearly relative to the pins 482, 483 to expand or contract the gap (G) so that the gap (G) has a same or similar height as that of the load holder device 500. The maximum height of the gap (G) is limited by a top region 484 of the center pin 483 which has a width that is greater than that of the main linear body of the center pin 483 and also greater than a width of the hole 473, but inserted in the opening 472 which also has a greater width than the hole 473.

Therefore, during an assembly operation, as shown in FIGS. 12A and 12B, the load holder device 500 is inserted in the gap (G) between the bottom element 490 and mandrel 454 to form a spacing (S) (shown in FIG. 12B) between a topmost surface of the side pins 482A, B and two grooved extensions 403 of the insulative ring 408 positioned about the mandrel 454 and separated 180 degrees from each other about the ring 408. The spacing (S) permits the insulative ring 408 to directly abut the lip 465 of the sleeve alignment feature 466 since the side pins 482A, B do not interfere with or otherwise prevent the extensions 403 from extending in the first and second side grooves 471A, 471B, respectively, which in turn extend down the sidewalls of the mandrel 454 in the same longitudinal direction as the mandrel 454. The insulative ring may also include a lip 407 or the like that is aligned with the grooved extensions 403 to assist with navigating a voice coil leadout wire 37 into the grooved extension 403 of the insulative ring 408.

During an optional helicoidal leadout formation process, as shown in FIG. 13A, the miniature voice coil 35 of the electro-acoustic transducer comprises a pair of helicoidal leadout regions 37A, B at the ends of the conductive voice coil wire.

A user may manually pilot each of the two leadout wires 37A, B of the voice coil 35 by positioning the leadout wires 37A, B, in grooves extending through the grooved extensions 403 of the insulative ring 408, and rotating the bobbin 33 about the mandrel 454. The tensed voice coil wiring is wrapped about the mandrel 454 to form the helicoidal portions 37A, B. In other examples, instead of rotating the bobbin 33 and voice coil 35, the leadout wires 37A, B can be wrapped about the mandrel 454 then inserted into the grooves of the insulative ring extensions 403. As shown in FIG. 13B, The leadout wires 37A, B are secured in the extensions 403 using a bonding technique, preferably using glue or adhesive that fills the grooves in the extension 403 to adhere the wires 37A, B in place in the extension 403. Here, the glue may also adhere to the sleeve 22 (see FIG. 13C) and cures while the sleeve 22 is in place, thereby also bonding the insulative ring 408 to an interior surface of the sleeve 22.

As shown in FIG. 13C, a sleeve 22 may be positioned over the assembly including bobbin 33, voice coil 35, and insulative ring 408 and rests on the lip 467 of the base portion 468 of the mandrel 454. In doing so, the sleeve 22 is aligned with the bobbin 33, i.e., so that a uniform distance between the bobbin 33 and interior wall of the sleeve 22 is uniform about the circumference of the sleeve 22.

Referring to FIG. 14, the tool 450 and miniature assembly of the electro-acoustic transducer attached thereto, which includes the bobbin 33, voice coil 35, sleeve 22, and insulative ring 408, are collectively inserted into a lander device 510, also referred to as an assembly lowering fixture. The lander device 510 has an opening configured to receive the entire combination of the tool 450 and assembly. Also, a slug 520 may be inserted in the opening of the lander device 510 prior to the tool 450 and assembly combination. In doing so, as shown in FIGS. 16, 16A, and 16B, the lander device 510 may be inverted, or flipped upside down, so that the bobbin 33, or preferably a dome of the bobbin 33 faces a ground surface. Here, the weight of the slug 520 along with gravity causes the assembly to move in a direction out of the lander device 510 and linearly toward the ground surface. In particular, as shown in FIG. 16A, the dome of the bobbin 33 drops down first due to gravity until the dome surface is aligned with the legs 511 of the lander device 510. The bobbin 33 remains coupled to the mandrel 454 due to friction, for example, when the bobbin 33 is press-fit against the mandrel 454.

Since the insulative ring 408 is attached to the sleeve 22 due to the gluing step shown in FIGS. 13B and 13C, the sleeve 22 and insulative ring 408 move together. Thus, when the pins 482A, B apply a force against the insulative ring 408, as shown in FIG. 16B, i.e., pushed in a downward direction, the gap G shown in FIG. 16 between the bottom element 490 and mandrel 454 is reduced to a smaller gap G' shown in FIG. 16B. Also an offset "O" is formed between the sleeve 22 and the bobbin 33 when the pins 482A, B apply a force to the insulative ring 408, i.e. pressed by the pin with loss option. To achieve this, the sleeve 22 and insulative ring 408 are pushed in a downward direction to the sleeve 22 is aligned with the outermost surface of the dome of the bobbin 33 and may also be aligned with the lander legs 511 as shown in FIG. 16B.

As shown in FIG. 16C, the miniature assembly of the electro-acoustic transducer attached thereto, which includes the bobbin 33, voice coil 35, sleeve 22, and insulative ring 408 are aligned in the lander device 510 is removed from the lander device 510, for example, due to gravity. In some examples, the slug 520 is also removed from the lander device 510 as shown in FIG. 16C. In other examples, a magnet is present in the lander device 510 to retain the slug 520 in place in the lander device 510 so that only the tool 450 and electro-acoustic transducer are removed from the lander device 510.

As shown in FIG. 17, after the tool 450 and miniature transducer assembly are removed from the lander device 510, the assembly is positioned over a sheet of silicone 550, then placed or dropped into the silicone. During fabrication, the tool 450 holding the miniature transducer assembly may be positioned on a silicone sheet or a microfabricated suspension and affixed with glue. Subsequently, the sheet of silicone 550 is ready for a trim procedure, for example, by way of laser, punch, or cut so that silicone does not protrude from the periphery of the sleeve 22, and thereby completing formation of the surround 34. In some examples, the silicone surround 34 is formed in a different step. In some examples, the bobbin 33 and sleeve 22 directly contact the liquid silicone in the same method step.

As shown in FIG. 18, the tool 450 is separated from the miniature transducer assembly, or more specifically, a portion of a transducer assembly including the sleeve 22, bobbin 33, voice coil 35, and insulative ring 408. One separation technique may include physically using tweezers, pliers, or the like that include two protruding elements such as claws or the like that apply a force against the mandrel 454 or sleeve 22, and wherein the user physically pulls one of the mandrel 454 or sleeve 22 away from the other of the mandrel 454 or sleeve 22. Another separation technique may include a magnet that produces a field that attracts metal elements such as the mandrel 454 away from the transducer assembly. Regardless of separation technique, when the lander core 480 is depressed, the side pins 482A, B directly abut the insulative ring 408, and the center pin 483 directly abuts the dome top of the bobbin 33. When released from the lander device 510, the side pins 482A, B of the tool 450 press down and apply a force on the insulative ring 408 to separate the transducer assembly from the mandrel 454, which moves relative to the pins 482, 483, as shown in FIGS. 19 and 20. As part of the ejection step, the sleeve 22 overdrives the bobbin dome 33 within a predetermined excursion limit, for example, 0.2 mm. Here, a goal is to reduce the stress applied to the surround 34 when removing the tool 450, which can be achieved by the insulative ring 408 directly abutting the side pins 482A, B during removal, while the center pin 482 applies a force against the bobbin dome 33 when the lander core device 480 is depressed.

The foregoing illustrates and describes a pick and place procedure, where a lander device 510 is used to receive, hold in place, and align the elements of the transducer assembly including the sleeve 22, bobbin 33, voice coil 35, and insulative ring 408.

Figure 22:
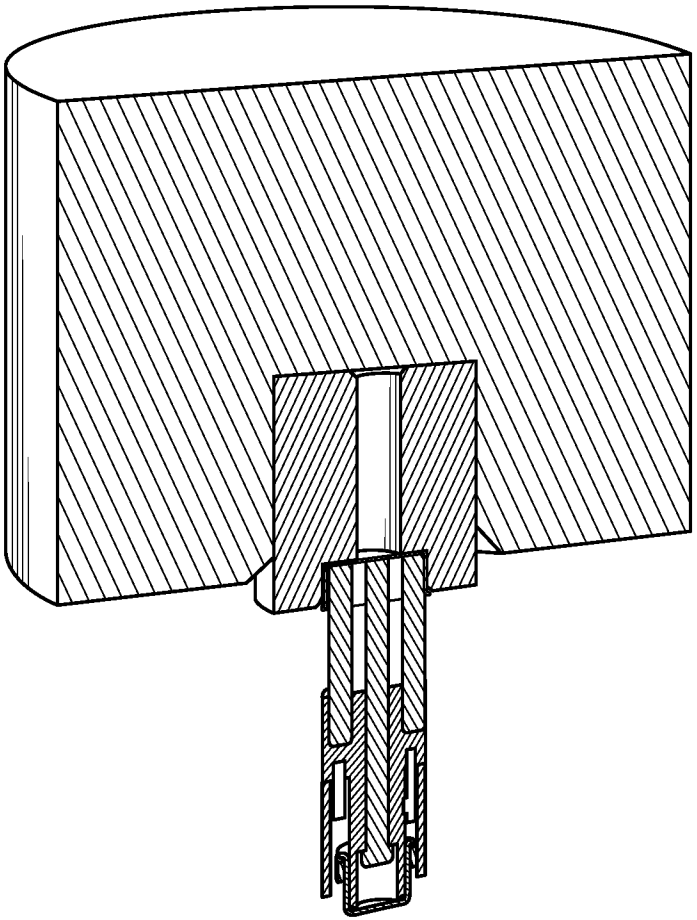
Figure 21:
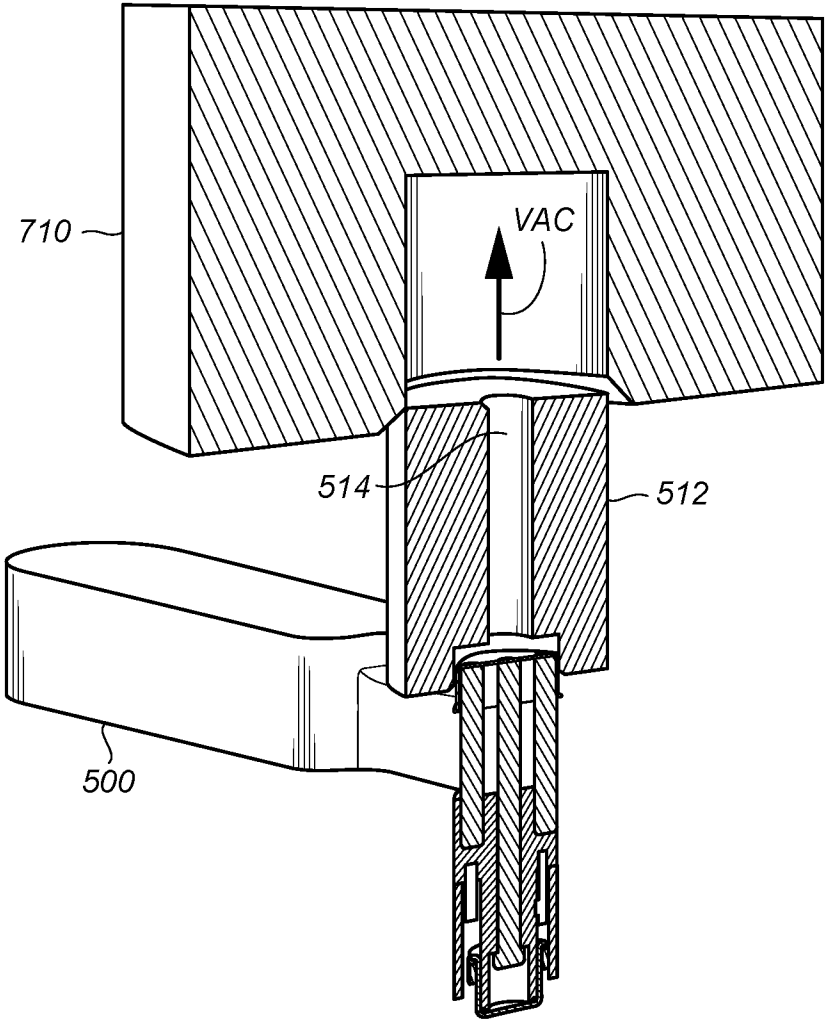
Figure 24:
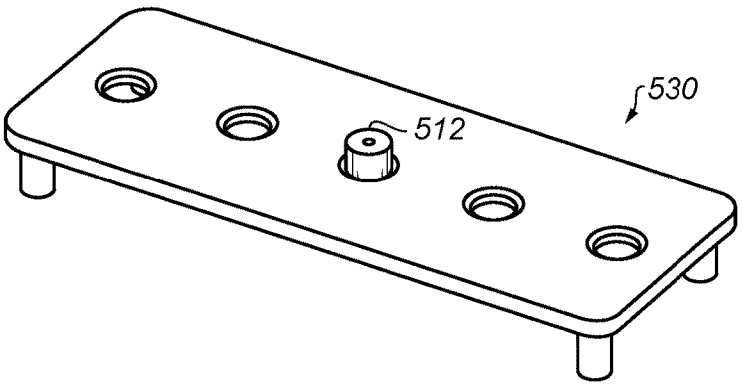
Figure 23:
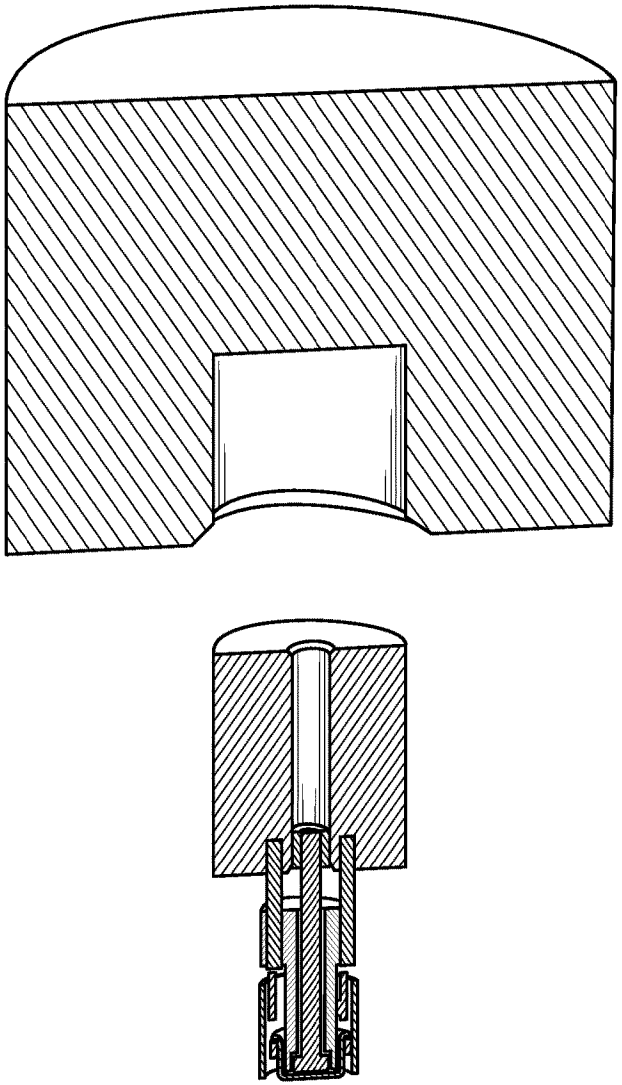

In other examples, for example, FIGS. 21-24, in lieu of a lander device 510, a robotic application may be used where the transducer assembly is loaded into a multi-degree of freedom (DoF) robot EoAT 710, e.g., a 3-axis robot, using a cylindrical element 512 or landing weight, similar to slug 520 illustrated and described in FIGS. 14-16C. The cylindrical element 512, or slug, may include one or more holes 514 for allowing a vacuum to be applied via a vacuum system (not shown) of the EoAT 710 to the transducer assembly to pull the transducer assembly and cylindrical element 512 toward the EoAT 710. As shown in FIG. 21, the load holder tab 500 may be inserted between the mandrel 454 and bottom element 490 of the lander core device 480, and a user can use the tab 500 to physically insert the bottom element 490 into the cylindrical element 512. In FIG. 22, the cylindrical element 512 is positioned in the EoAT 710 by a vacuum. In FIG. 23, the robot EoAT 710 may be retracted vertically for relocating the transducer assembly to a predetermined location (not shown), for example, where a sheet of silicone may be applied for forming a diaphragm or surround. As shown in FIG. 24, the transducer assembly and cylindrical element 512 may be dropped into a tilt protector 530, also referred to as a stabilizing tray, for further transfer. The apparatus is now ready for a trimming operation with respect to the silicone surround or the like.

FIG. 25 is a perspective view of an example of another tool 650 for assembling an electro-acoustic transducer, for example, a transducer similar to or the same as that shown in FIG. 1. The tool 650 shown and described FIG. 25 is constructed and arranged to assemble a miniature electro-acoustic transducer having a bobbin without a dome or related top region. For example, the bobbin may be cylindrical with an open top region that exposes a mandrel 654 extending therethrough.

In some examples, the tool 650 comprises the mandrel 654, a conductive leadout hook ring 606, and an insulative ring 604 (also referred to as a "flex circuit").

As shown in FIG. 25, the mandrel 654 comprises a bobbin alignment feature 662, a leadout hook ring alignment feature 664, a sleeve alignment feature 666, and a base portion 668, some or all of which may be similar to counterpart elements in mandrel 454 of FIGS. 10-24. In some examples, the bobbin alignment feature 662, leadout hook ring alignment feature 664, sleeve alignment feature 666, and base portion 668 are formed, for example, molded or machined, of a single stock of material. In other examples, the bobbin alignment feature 662, leadout hook ring alignment feature 664, a sleeve alignment feature 666, and/or base portion 668 are formed separately, and coupled together by bonding or other coupling technique.

The bobbin alignment feature 662 is constructed and arranged at a topmost region of the mandrel 654 for receiving an open-faced bobbin 33 and voice coil 35 (see for example FIG. 27), and for positioning in an interior of the bobbin 33, and for aligning or centering the bobbin 33 during a subsequent operation that includes the formation of helicoidal leadout regions 37A, B at the ends of a conductive wiring of the voice coil 35.

The leadout hook ring alignment feature 664 and channel 671 are constructed and arranged to receive and hold in place, also with lip 665 between leadout hook ring alignment feature 664 and sleeve alignment feature 666, a leadout hook ring 602 during the leadout formation process. An interior of the leadout hook ring alignment feature 664 may receive a top region 681 of a lander core device 680 extending between two side pins 682A, B in turn coupled to bottom element 690. The top region 681 and side pins 682A, B collectively form an arch-shaped element of the lander core device 680, since no center pin is required, i.e., since the bobbin has no dome to communicate with a center pin. Here, the top region 681 may directly abut the coplanar bottom surfaces of the voice coil 35 and bobbin 33, or in other examples, directly abut the bottom surface of the bobbin 33 only.

The sleeve alignment feature 666 has a width or diameter greater than the leadout hook ring alignment feature 664, and therefore includes a lip 665 or the like that extends from the outermost circumference of the leadout hook ring alignment feature 664. A sleeve 22 can be positioned over the sleeve alignment feature 666 in a manner that provides for alignment between the sleeve 22 and the bobbin 33 and voice coil 35.

The base portion 668 has a width or diameter greater than the sleeve alignment feature 666, and therefore includes a lip 667 or the like that extends from the outermost circumference of the sleeve alignment feature 666. The sleeve 22 positioned over the sleeve alignment feature 666 rests on the lip 667 as part of the alignment of the sleeve 22 relative to the voice coil bobbin 33.

The mandrel 654 includes an opening 672, or groove or the like extending to a hole 673 that extends through the bobbin alignment feature 662, leadout hook ring alignment feature 664, sleeve alignment feature 666, and base portion 668, respectively. The mandrel 654 also includes first and second side grooves 671A, 671B (generally, 671) for receiving a side pin 682A, B (generally, 682) of a lander core device 680, wherein the mandrel 654 slides up and down freely relative to the lander core device 680.

The lander core device 680 may be similar to device 480 of FIGS. 10-25, and may include a bottom element 690 preferably coupled to two side pins 682 extending from a central region 681 positioned in the mandrel hole 673, and more specifically, positioned in the interior of the leadout hook ring alignment feature 664 but not limited thereto. The lander core device 680 is constructed and arranged to conform with the various sections of the mandrel 654, for example, the side pins 682 aligning with the base portion 668 of the mandrel 454. The opening 672 may extend down the sidewalls of the mandrel 654 to be 90 degrees from, or perpendicular to, the grooves 671. The opening 672 and side grooves 671 of the mandrel 654 are of a dimension allowing the mandrel 654 to move linearly, e.g., up and down, relative to the lander core device 680 and bottom element 690, or so that the side pins 682A, B (generally, 682) of the lander core device 680 move relative to the lander core device 680. The bottom element 690 may be cylindrical, and include side grooves, holes, or the like for receiving and coupling to the side pins 682 of the arch-shaped lander core device 680.

FIGS. 26-32 are perspective and cutaway views of various method steps for assembling an electro-acoustic driver using the tool 650 of FIG. 25, in accordance with some examples.

Figure 26:
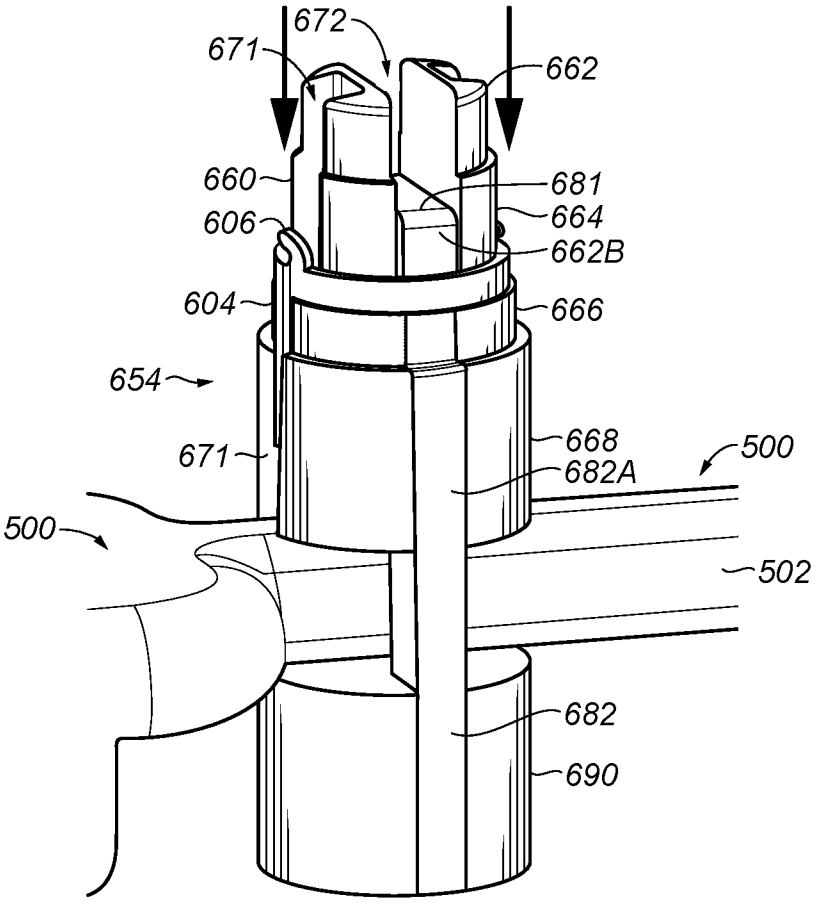

As shown in FIG. 26, the method may include first assembling the tool 650, which may include but not be limited to positioning the leadout hook ring 602 and ring 604 about the leadout hook ring alignment feature 64 and on the lip 665 of the sleeve alignment feature 466. An extension 603 of the insulative ring 604 and a vertical extension 605 of the conductive leadout hook ring 602 may each extend along a groove 671 or the like in the mandrel 654. The insulative ring extension 603 at least partially covers the conductive extension 605.

Also, the load holder tab 500 may have a single leg 502 that is inserted between the two side pins 682 in a gap of the hole 672 formed between the bottom element 690 and the bottommost surface of the base portion 668 of the mandrel 654.

Figure 27:
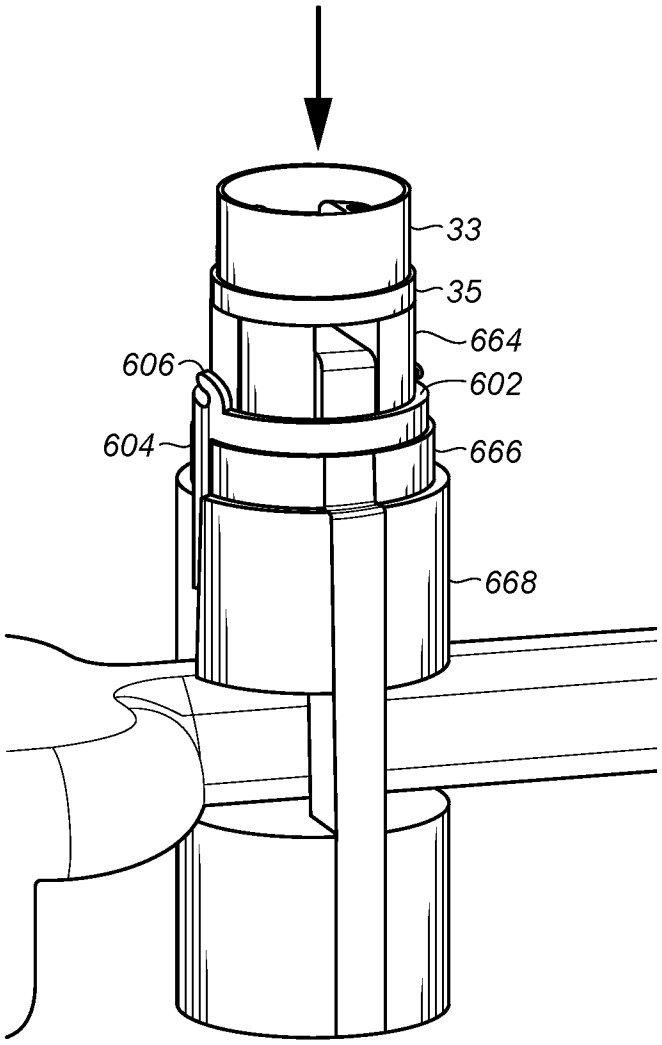

As shown in FIG. 27, the bobbin 33 and voice coil 35 are positioned on the bobbin alignment feature 462 of the mandrel 454, to rest on the lip 663 between the bobbin alignment feature 462 and the leadout hook ring alignment feature 664. The bobbin 33 in some examples may have a closed or dome top, but is not limited thereto.

Figure 28A:
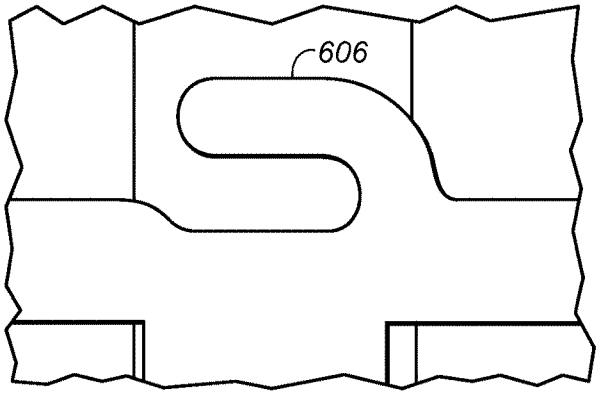
Figure 28B:
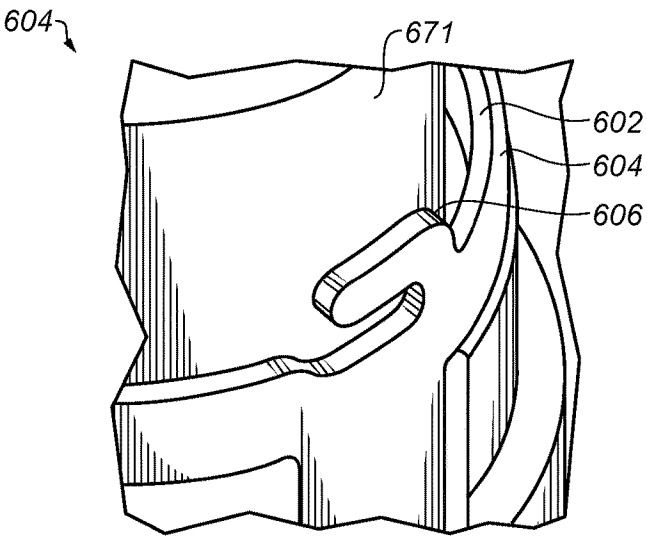
Figure 28:
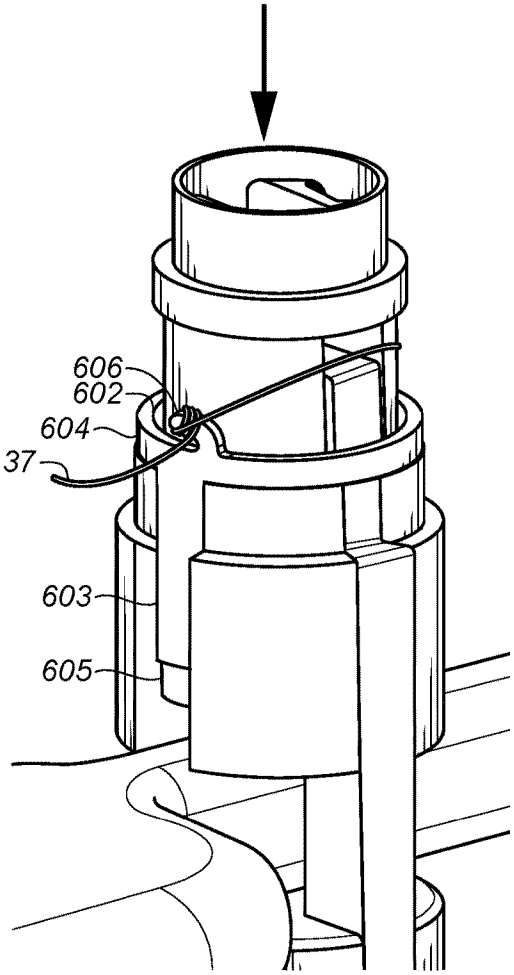

As shown in FIG. 28, a portion of a leadout region 37 is wrapped about a conductive hook 606 or other protruding portion of the leadout hook ring 602 inside the insulative ring 604. The bobbin 33 or the insulative ring 604 may be rotated to form the helicoidal shape of the leadout regions 37. Alternatively, a user can wrap the voice coil wiring manually, for example, using tools, to form the helicoidal shape of the leadout regions 37.

As shown in FIG. 28A, as an alternative to soldering, after the leadout wiring is wrapped about the conductive hook 606, the hook 606 may be pinched or otherwise moved in a downward direction by a force to form a hole between the hook 606 and the main body of the conductive hook ring 602. Alternatively, as shown in FIG. 28B, a force, such as manual pressing, may occur to move the hook 606 inward to create a solder landing.

Figure 29A:
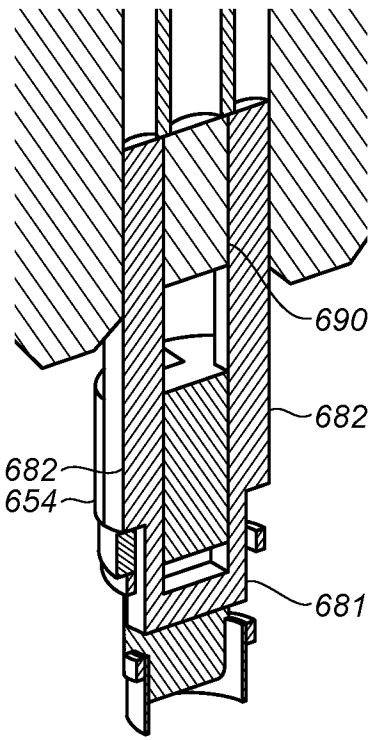
Figure 29:
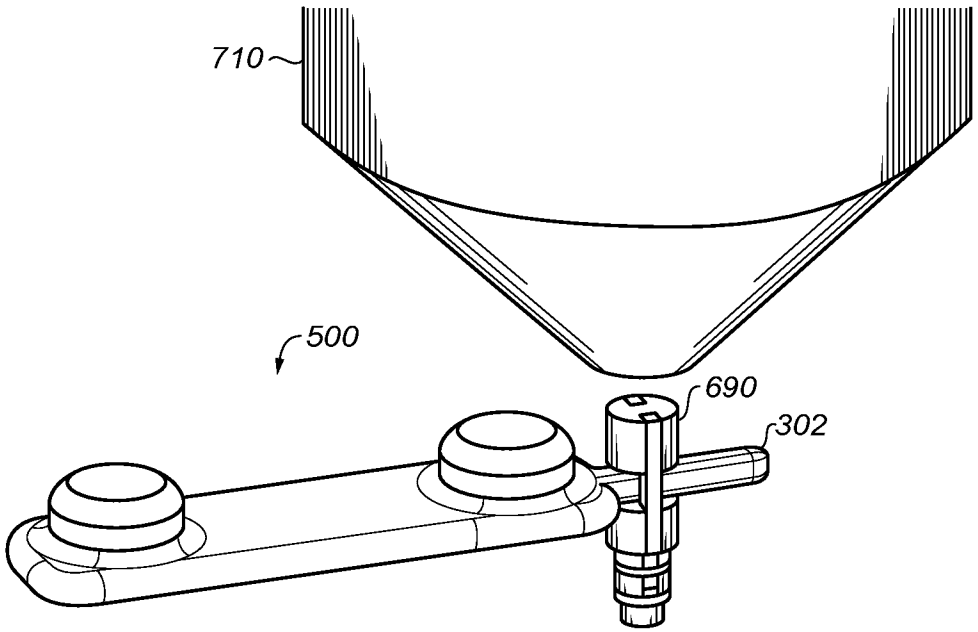

As shown in FIG. 29, the load holder device 500 is used to load the bottom element 690 of the tool 650 into an end-of-arm tooling (EoAT) device 710, which may be similar to or the same as the EoAT device shown and described with respect to FIGS. 21-23. As shown in FIG. 29A, a vacuum retains the bottom element 690. Alternatively, or in addition, a magnet may be applied. In doing so, the load loader device 500 may be removed, i.e., the load holder tab leg 502 is removed from the open region between the side pins 682, and between the mandrel 454 and bottom element 690.

Figure 31:
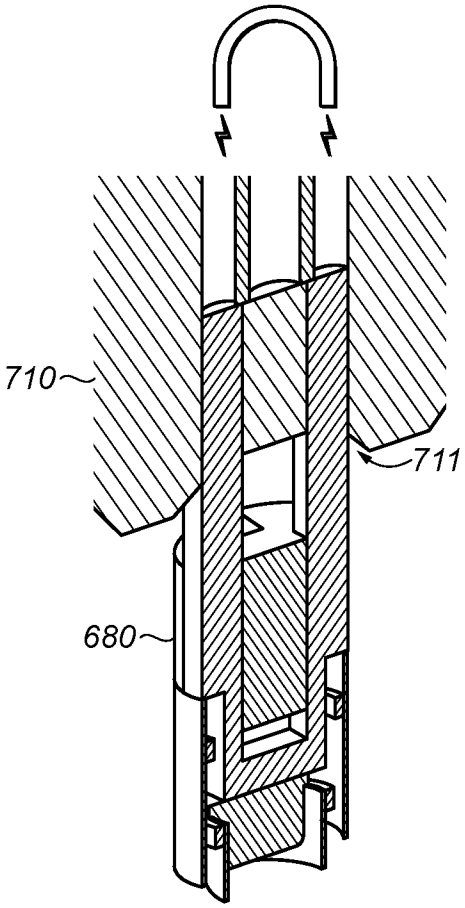
Figure 30:
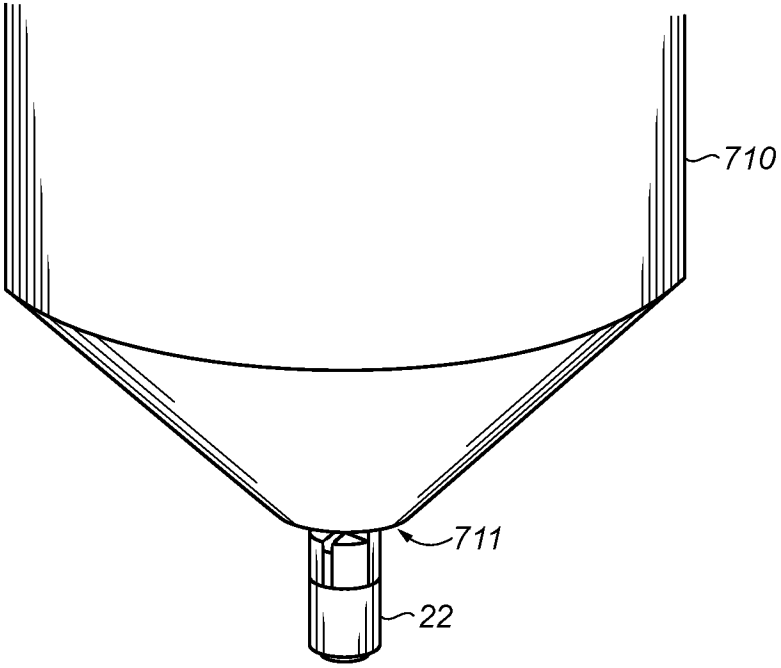

As shown in FIG. 30, a sleeve 22 can be positioned over the sleeve alignment feature 466 of the mandrel 454, which in turn is loaded into the EoAT device 710. The EoAT device 710 may have openings configured to receive the bottom element 690 and end portions of the pins 482 positioned in the bottom element 690. As shown in FIG. 31, a magnet can be used to retain the sleeve 22 about the mandrel 654.

Figure 32:
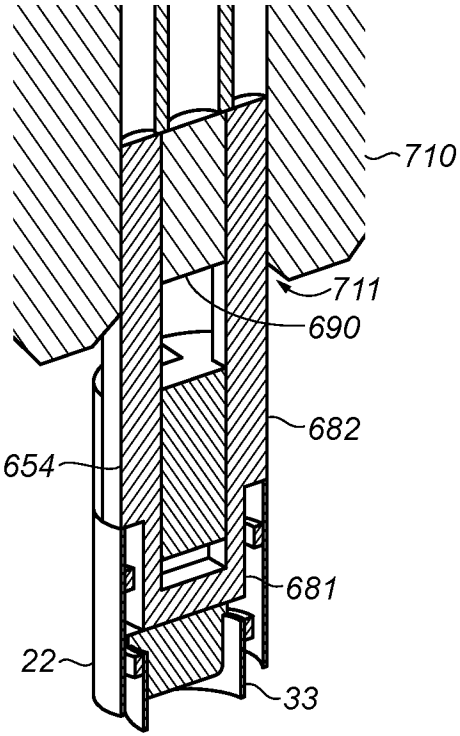

In FIG. 32, the assembly and tool 650 are removed from the EoAT device 710.

What is claimed is:

1. An electro-acoustic transducer, comprising:

a sleeve having a first end and a second end;

a voice coil within the sleeve;

a magnetic assembly in magnetic communication with the voice coil in the sleeve between the first end and the second end;

a conductive wire extending from the voice coil, a portion of the conductive wire including helicoidal leadout regions; and a gluing ring coupled to an interior of the sleeve, the gluing ring including guide paths to which distal ends of the helicoidal leadout regions are coupled.

2. The electro-acoustic transducer of claim 1, wherein the gluing ring includes two insert notches constructed and arranged for receiving the distal ends of the helicoidal leadout regions.

3. The electro-acoustic transducer of claim 2, wherein the insert notches include an adhesive for coupling portions of the voice coil helicoidal leadout regions to the gluing ring.

4. The electro-acoustic transducer of claim 2, wherein the insert notches are 180 degrees from each other, and wherein each helicoidal leadout region includes a bend to form the distal ends of the helicoidal leadout regions extending from the gluing ring in a longitudinal direction of extension of the sleeve.

5. The electro-acoustic transducer of claim 1, further comprising a circuit board at the second end of the sleeve, wherein the distal ends of the helicoidal leadout regions extends from the gluing ring to the circuit board.

6. The electro-acoustic transducer of claim 1, further comprising a bobbin coupled to a diaphragm positioned about an opening of the sleeve at the first end of the sleeve opposite the second end of the sleeve at which the gluing ring is coupled to the interior of the sleeve.

7. The electro-acoustic transducer of claim 1, wherein the gluing ring includes a rotation-locking feature.

8. An electro-acoustic transducer, comprising:

a sleeve having a first end and a second end;

a voice coil within the sleeve;

a magnetic assembly in magnetic communication with the voice coil in the sleeve between the first end and the second end;

a conductive wire extending from the voice coil, a portion of the conductive wire including a first helicoidal leadout region and a second helicoidal leadout region; and a gluing ring in the sleeve, wherein the first helicoidal leadout region includes a bend at a first location of the gluing ring and the second helicoidal leadout region includes a bend at a second location of the gluing ring that is at an opposite side of the gluing ring as the first location.

9. The electro-acoustic transducer of claim 8, wherein the gluing ring includes a first gluing notch at the first location and a second gluing notch at the second location that is 180 degrees from the first gluing notch, the bend of the first helicoidal leadout region coupled to the first notch, and the bend of the second helicoidal leadout region coupled to the second notch.

10. The electro-acoustic transducer of claim 9, wherein the first and second gluing notches include an adhesive for coupling portions of the first and second helicoidal leadout regions to the gluing ring.

11. The electro-acoustic transducer of claim 8, wherein the gluing ring separates the first and second helicoidal leadout regions from each other in the sleeve.

12. The electro-acoustic transducer of claim 8, wherein the gluing ring includes guide paths to which distal ends of the first and second helicoidal leadout regions are coupled.

13. The electro-acoustic transducer of claim 8, further comprising a circuit board at the second end of the sleeve, wherein distal ends of the first and second helicoidal leadout regions extend from the gluing ring to the circuit board.

14. The electro-acoustic transducer of claim 8, further comprising a bobbin coupled to a diaphragm positioned about an opening of the sleeve at one end of the sleeve opposite an end of the sleeve at which the gluing ring is coupled to the interior of the sleeve.

15. The electro-acoustic transducer of claim 8, wherein the gluing ring includes a rotation-locking feature.

16. A transducer assembly formed according to the method steps of:

aligning a bobbin and voice coil;

positioning a gluing ring for providing guide paths for distal ends of leadout regions of the voice coil; and rotating the leadout regions to form helicoidal portions of the voice coil.

17. The transducer assembly of claim 16, wherein the method steps further comprise:

loading the transducer assembly into a robot end of arm tooling (EoAT) apparatus to at least one of hold in place and align bobbin and voice coil of the transducer assembly or transfer the transducer assembly to a source of silicone for forming a surround.

18. The transducer assembly of claim 16, wherein the method step of aligning the bobbin and voice coil comprises:

positioning the bobbin and voice coil about a mandrel of a tool;

positioning the gluing ring comprises positioning the gluing ring about the mandrel; and rotating one of the voice coil and the mandrel relative to the other of the voice coil and the mandrel.

19. The transducer assembly of claim 16, wherein the method steps further comprise:

forming the guide paths from two notches of gluing ring constructed and arranged for receiving the distal ends of the leadout regions.

20. The transducer assembly of claim 16, wherein the method steps further comprise:

forming a bend in each leadout region so that the distal ends of the leadout regions extend from the gluing ring along the guide paths.

* * * * *